US011115762B2

(12) United States Patent
Sigwanz et al.

(10) Patent No.: US 11,115,762 B2
(45) Date of Patent: Sep. 7, 2021

(54) HEARING DEVICE FOR OWN VOICE DETECTION AND METHOD OF OPERATING A HEARING DEVICE

(71) Applicant: Sonova AG, Stafa (CH)

(72) Inventors: Ullrich Sigwanz, Hombrechtikon (CH); Nadim El Guindi, Zurich (CH); Daniel Lucas-Hirtz, Rapperswil (CH); Nina Stumpf, Mannedorf (CH)

(73) Assignee: SONOVA AG, Stäfa (CH)

( * ) Notice: Subject to any disclaimer, the term of this patent is extended or adjusted under 35 U.S.C. 154(b) by 0 days.

(21) Appl. No.: 16/832,134

(22) Filed: Mar. 27, 2020

(65) Prior Publication Data

US 2020/0314565 A1 Oct. 1, 2020

(30) Foreign Application Priority Data

Mar. 29, 2019 (EP) ..... 19166291

(51) Int. Cl.
*H04R 25/00* (2006.01)
*G10L 25/51* (2013.01)
*G10L 25/78* (2013.01)

(52) U.S. Cl.
CPC ..... *H04R 25/505* (2013.01); *G10L 25/51* (2013.01); *G10L 25/78* (2013.01); *H04R 25/40* (2013.01); *H04R 25/604* (2013.01)

(58) Field of Classification Search
CPC ..... H04R 25/604; H04R 25/505; H04R 3/04; H04R 1/326; H04R 2400/03; H04R 25/353; H04R 1/22; H04R 25/305; H04R 25/40; G10L 25/51; G10L 25/78;
(Continued)

(56) References Cited

U.S. PATENT DOCUMENTS 8,477,973 B2 7/2013 Merks
9,271,091 B2 2/2016 Zurbrugg
9,313,572 B2 4/2016 Dusan et al.
(Continued)

FOREIGN PATENT DOCUMENTS

EP 2 482 566 A1 8/2012
EP 2 699 021 B1 2/2014
EP 3 328 097 A1 5/2018

OTHER PUBLICATIONS

European Search Report for 19 16 6291 dated Sep. 6, 2019.

*Primary Examiner* — Norman Yu
(74) *Attorney, Agent, or Firm* — Pearne & Gordon LLP

(57) ABSTRACT

A hearing device configured to be worn at a head of a user. The hearing device includes a vibration sensor to detect a vibration conducted through the user's head to the hearing device and to output a vibration signal including information about the vibration. At least part of the vibration can be caused by an own voice activity of the user. A method of operating the hearing device allows a reliable own voice detection at rather low processing effort. The processor determines a presence of an own voice characteristic in the vibration signal at a vibration frequency associated with the own voice characteristic and identifies the own voice activity based on an identification criterion including the presence of the own voice characteristic in the vibration signal at the associated vibration frequency. The own voice characteristic indicative of part of the vibration can be caused by the own voice activity.

17 Claims, 10 Drawing Sheets

(58) Field of Classification Search
CPC ... G10L 2015/225; G10L 25/87; G10L 25/90; G10L 15/02; G10L 15/08
USPC ... 381/151, 312, 326, 313, 92, 122, 309, 58, 381/74, 56, 71.2, 98
See application file for complete search history.

(56) References Cited

U.S. PATENT DOCUMENTS

| | | | | |
|---|---|---|---|---|
| 9,584,932 | B2 | 2/2017 | Zurbruegg et al. | |
| 2008/0260180 | A1 | 10/2008 | Goldstein et al. | |
| 2011/0026722 | A1* | 2/2011 | Jing | G10L 25/84 381/71.1 |
| 2018/0324518 | A1* | 11/2018 | Dusan | G10L 25/06 |
| 2018/0330588 | A1* | 11/2018 | Kitic | G08B 13/1663 |
| 2018/0367882 | A1* | 12/2018 | Watts | H04R 1/1083 |

* cited by examiner

HEARING DEVICE FOR OWN VOICE DETECTION AND METHOD OF OPERATING A HEARING DEVICE

This application claims priority from European Patent Application No. 19166291.5 filed on Mar. 29, 2019. The content of this application is incorporated herein by reference in its entirety.

TECHNICAL FIELD

This disclosure relates to a hearing device comprising a vibration sensor configured to detect a vibration at least partially caused by an own voice activity of a user, according to the preamble of claim 1. The disclosure further relates to a method of operating a hearing device comprising such a vibration sensor, according to the preamble of claim 15.

BACKGROUND

Hearing devices may be used to improve the hearing capability or communication capability of a user, for instance by compensating a hearing loss of a hearing-impaired user, in which case the hearing device is commonly referred to as a hearing instrument such as a hearing aid, or hearing prosthesis. A hearing device may also be used to produce a sound in a user's ear canal. Sound may be communicated by a wire or wirelessly to a hearing device, which may reproduce the sound in the user's ear canal. For example, earpieces such as earbuds, earphones or the like may be used to generate sound in a person's ear canal. Furthermore, hearing devices may be employed as hearing protection devices that suppress or at least substantially attenuate loud sounds and noises that could harm or even damage the user's sense of hearing. Hearing devices are often employed in conjunction with communication devices, such as smartphones, for instance when listening to sound data processed by the communication device and/or during a phone conversation operated by the communication device. More recently, communication devices have been integrated with hearing devices such that the hearing devices at least partially comprise the functionality of those communication devices.

Identifying an own voice activity of a user of the hearing device can be desirable for a number of reasons. For instance, an occlusion of an ear of the user can provoke an unnatural perception of a sound associated with the own voice activity. Occlusion occurs when an inner region of an ear canal is at least partially sealed from an ambient environment outside the ear canal. For instance, an otoplastic or other hearing device component inserted into the ear canal can provoke such a sealing. As a consequence of the sealing, an acoustic connection between the inner region of the ear canal and the ambient environment outside the ear canal can be strongly reduced or cut off such that little or no pressure equalisation in between the isolated regions can take place. The occlusion effect can then be caused by bone-conducted vibrations reverberating in the sealed inner region of the ear canal, so that speaking, chewing, body movement, heart beat or the like may create echoes or reverberations in the inner region. Those reverberations can add to an airborne sound produced by the own voice activity and even dominate the sound perception of the user. The user then may perceive "hollow" or "booming" echo-like sounds during the own-voice activity and/or the user may perceive his own voice as too loud. After identifying the own voice activity, the occlusion effect can be at least partially mitigated, for instance by an appropriate processing of an audio signal for reproducing a sound of the user's own voice and/or by activating a venting of the ear canal to the ambient environment. Own voice detection can also be desirable to recognize a situation in which the user is involved in a conversation or intends to communicate. Identifying such a hearing situation can be useful to adjust the audio processing or other hearing device parameters accordingly, for instance to provide a certain directionality of a beamformer or an ambient sound level particularly suitable for the user's communication, as compared to other hearing situations such as streaming a television program or listening to music. The own voice activity can include any deliberately caused vibration of the user's vocal chords, for instance a speech or coughing by the user.

Own voice detection can be applied in a hearing device to identify an own voice activity of the user. Various solutions for own voice detection have been proposed. Some solutions rely on a signal analysis of a sound signal detected by a microphone outside the ear canal. U.S. Pat. No. 8,477,973 B2 discloses two microphones arranged at different locations of the ear and an adaptive filter to process a difference signal of the signals obtained by the two microphones, wherein the presence of the wearer's own voice is determined by a comparison of the difference signal with the signal obtained by one of the microphones. U.S. Pat. No. 9,584,932 B2 proposes computing a difference between an audio signal picked up by an ear canal microphone and a filtered audio signal obtained from a signal processing unit after recording by an ambient microphone in order to identify the presence of an own voice sound. U.S. Pat. No. 9,271,091 B2 discloses a method of own voice shaping by estimating an ambient sound portion and an own voice sound portion from audio signals recorded by an outer microphone and an ear canal microphone and adding the sound portions after a separate signal processing. Other solutions are based on picking up the user's voice transmitted from the user's vocal chords to the ear canal wall via bone conduction through the user's head. For this purpose, a bone conductive microphone or a pressure sensor, as disclosed in European Patent No. EP 2 699 021 B1, may be employed to probe the bone conducted signal. U.S. Pat. No. 9,313,572 B2 discloses a voice activity detector comprising microphones and an inertial sensor for detecting a voiced speech of the user by computing a coincidence of the speech included in the audio signal detected by the microphone and of the vibration of the user's vocal chords detected by the inertial sensor.

Those prior art solutions can require a rather processing intensive analysis of a detection signal recorded by the microphones or bone vibration detectors which impedes a desirable quick identification of the own voice activity. Moreover, the reliability of own voice detection can be compromised by the detector position, for instance when a good contact of the bone vibration probe to the irregular shape of an ear canal wall is required.

SUMMARY

It is an object of the present disclosure to avoid at least one of the above mentioned disadvantages and to provide a hearing device and/or a method of operating the hearing device allowing a detection of the user's own voice activity in a rather uncomplicated manner, in particular such that a signal processing required for the own voice detection can be kept less intensive. It is another object to enable the own voice detection in a rather time efficient manner, in particular such that an occurrence of an own voice activity can be determined with a minimum delay. It is a further object to increase the reliability of own voice detection, in particular such that the likelihood of false detections and/or missing detections of the own voice activity can be reduced. It is another object to provide enhancement of additional own voice detection devices and/or methods, in particular such that the additional own voice detection can be equipped with increased reliability. It is yet another object to enable the own voice detection in a manner allowing recognition of a content of a speech of the user, in particular to increase the reliability of current speech recognition techniques.

At least one of these objects can be achieved by a hearing device comprising the features of patent claim 1 and/or in a method of operating a hearing device comprising the features of patent claim 15. Advantageous embodiments of the invention are defined by the dependent claims.

The present disclosure proposes a hearing device configured to be worn at least partially at a head of a user. The hearing device comprises a vibration sensor configured to detect a vibration conducted through the user's head to the hearing device, wherein at least a part of the vibration is caused by an own voice activity of the user. The vibration sensor is configured to output a vibration signal comprising information about said vibration. The hearing device further comprises a processor communicatively coupled to the vibration sensor. The processor is configured to determine a presence of an own voice characteristic in the vibration signal at a vibration frequency associated with the own voice characteristic. The own voice characteristic is indicative of said part of the vibration caused by the own voice activity. The processor is further configured to identify the own voice activity based on an identification criterion comprising said presence of the own voice characteristic in the vibration signal at the associated vibration frequency.

Own voice detection based on such an identification criterion of the own voice activity can be implemented in a rather processing efficient manner such that the own voice activity may be identified with small delay. Beyond that, the detection reliability can be enhanced, in particular when the identification criterion incorporates further conditions, as further detailed below, and/or when such an own voice identification is complemented by another own voice detection technique. The identification criterion can also by employed for a speech recognition, as further described below.

Independently, the present disclosure proposes a binaural hearing system comprising said hearing device as a first hearing device, and further comprising a second hearing device.

Independently, the present disclosure proposes a method of operating a hearing device configured to be worn at least partially at a head of a user. The method comprises detecting a vibration conducted through the user's head to the hearing device, wherein at least a part of the vibration is caused by an own voice activity of the user. The method further comprises providing a vibration signal comprising information about said vibration. The method further comprises determining a presence of an own voice characteristic in the vibration signal at a vibration frequency associated with the own voice characteristic, wherein the own voice characteristic is indicative of said part of the vibration caused by the own voice activity. The method further comprises identifying the own voice activity based on an identification criterion comprising said determined presence of the own voice characteristic in the vibration signal at the associated vibration frequency.

Independently, the present disclosure also proposes a non-transitory computer-readable medium storing instructions that, when executed by a processor, cause a hearing device to perform operations of this method.

In some implementations, the hearing device can comprise at least one of the subsequently described features. Each of those features can be provided solely or in combination with at least another feature. Each of those features can be correspondingly provided in some implementations of the binaural hearing system and/or of the method of operating the hearing device and/or of the computer-readable medium.

The processor can be configured to determine a signal feature of the vibration signal. The signal feature can comprise at least one frequency dependent characteristic of the vibration signal. In some implementations, the determining the presence of the own voice characteristic at the associated vibration frequency comprises simultaneous determining of a signal feature in the vibration signal and determining of a presence of the signal feature at the vibration frequency associated with the own voice characteristic. This can contribute to a processing efficient and fast detection of the own voice activity. In some implementations, the signal feature can comprise a peak in the vibration signal. The peak can be determined by a peak detection. In some implementations, the signal feature can comprise a signal level of the vibration signal.

In some implementations, the processor is configured to associate said own voice characteristic with a vibration frequency selected from a frequency range detectable by the vibration sensor. The processor can be configured to select the associated vibration frequency from the frequency range detectable by the vibration sensor. The processor can be configured to distinguish between a plurality of own voice characteristics each associated with a respective vibration frequency. The processor can be configured to determine a presence of a signal feature determined in the vibration signal at the vibration frequency associated with the own voice characteristic. In some implementations, the processor is configured to select the associated vibration frequency from a set of associated vibration frequencies. For instance, such a set of associated vibration frequencies may comprise frequencies separated from one another by a frequency difference.

The vibration signal can be time dependent. In particular, the vibration signal can be provided in a time domain representing a progressing time during which the vibration signal is detected. In some implementations, the vibration signal is recorded, in particular sampled, at successive points in time during a recording time, in particular sampling time. A recording rate, in particular sampling rate, can be defined as the number of recorded values of the vibration signal per time. In some implementations, the vibration signal is provided as an analog signal.

In some implementations, the processor is configured to evaluate the vibration signal in a frequency domain comprising a spectrum of vibration frequencies. Based on this evaluation, said presence of the own voice characteristic in the vibration signal at the associated vibration frequency may be determined. For instance, the vibration signal can be evaluated in the frequency domain by determining the power spectral density (PSD) of the vibration signal. In some implementations, the processor is configured to determine said presence of the own voice characteristic at the associated vibration frequency in the time dependent vibration signal. For instance, the presence of the own voice characteristic at the associated vibration frequency may be determined by evaluating the vibration signal in the time domain with respect to zero crossings, in particular in a zero crossing analysis, and/or in a time series analysis, in particular by a dynamic time warping.

In some implementations, the own voice characteristic is a first own voice characteristic in the vibration signal associated with a first vibration frequency and the processor is configured to determine a presence of a second own voice characteristic in the vibration signal at an associated second vibration frequency. The identification criterion can further comprise said presence of the second own voice characteristic in the vibration signal at the associated second vibration frequency. In this way, a reliability of the own voice detection may be enhanced. In some implementations, the first vibration frequency and the second vibration frequency can be selected to be different. The processor can be configured to determine a frequency distance of said different frequencies. The identification criterion can further comprise the frequency distance corresponding to a predetermined distance value.

In some implementations, the processor is configured to determine a temporal sequence of the presence of the first own voice characteristic and the second own voice characteristic in the vibration signal. The identification criterion can further comprise said presence of the first own voice characteristic temporally preceding said presence of the second own voice characteristic in the vibration signal. In particular, the processor can be configured to determine a first time of said presence of the first own voice characteristic in the vibration signal at the associated first vibration frequency, and to determine a second time of said presence of the second own voice characteristic in the vibration signal at the associated second vibration frequency. The identification criterion can further comprise said first time temporally preceding said second time. The first vibration frequency and the second vibration frequency can be selected to be different or equal. In some implementations, the processor is configured to evaluate a modulation of the vibration signal, for instance in a modulation analysis, to determine said temporal sequence of the own voice characteristics. In particular, the modulation of an amplitude of the vibration signal can be evaluated. In some implementations, the processor is configured to determine a time period of said temporal sequence. The identification criterion can further comprise the time period corresponding to a predetermined time interval.

In some implementations, the hearing device comprises a microphone configured to detect a sound conducted through an ambient environment of the user and to output an audio signal comprising information about said sound. The processor can be communicatively coupled to the microphone. In some implementations, the processor is configured to determine a presence of an own voice characteristic in the audio signal at an audio frequency associated with the own voice characteristic. The own voice characteristic in the audio signal can be indicative of at least a part of said sound which is caused by the own voice activity. The identification criterion can further comprise said presence of the own voice characteristic in the audio signal at the associated audio frequency. Thus, the own voice detection reliability may be improved. In some implementations, the processor is configured to distinguish between a plurality of vibration frequencies each associated with a respective own voice characteristic in the vibration signal and between a plurality of audio frequencies each associated with a respective own voice characteristic in the audio signal. The processor can be configured to relate each audio frequency of said plurality of audio frequencies with a respective vibration frequency of said plurality of vibration frequencies. Said identification criterion can further comprise said associated vibration frequency related to said associated audio frequency.

In some implementations, the own voice characteristic is a first own voice characteristic in the audio signal associated with a first audio frequency and the processor is configured to determine a presence of a second own voice characteristic in the audio signal at an associated second audio frequency. The identification criterion can further comprise said presence of the second own voice characteristic in the audio signal at the associated second audio frequency. In some implementations, the first audio frequency and the second audio frequency can be selected to be different. The processor can be configured to determine a frequency distance of said different frequencies. The identification criterion can further comprise the frequency distance corresponding to a predetermined distance value.

In some implementations, the processor is configured to determine a temporal sequence of the presence of the first own voice characteristic and the second own voice characteristic in the audio signal. The identification criterion can further comprise said presence of the first own voice characteristic temporally preceding said presence of the second own voice characteristic in the audio signal. In particular, the processor can be configured to determine a first time of said presence of the first own voice characteristic in the audio signal at the associated first audio frequency, and to determine a second time of said presence of the second own voice characteristic in the audio signal at the associated second audio frequency. The identification criterion can further comprise said first time temporally preceding said second time. The first audio frequency and the second vibration frequency can be selected to be different or equal. In some implementations, the processor is configured to evaluate a modulation of the audio signal, for instance in a modulation analysis, to determine said temporal sequence of the own voice characteristics in the audio signal. In some implementations, the processor is configured to determine a time period of said temporal sequence of own voice characteristics in the audio signal. The identification criterion can further comprise the time period corresponding to a predetermined time interval.

In some implementations, the hearing device comprises a database. The processor can be configured to retrieve the frequency associated with the own voice characteristic from the database, in particular at least one of the associated vibration frequency and the associated audio frequency. The processor can be configured to store the frequency associated with the own voice characteristic in the database, in particular at least one of the associated vibration frequency and the associated audio frequency.

In some implementations, the hearing device is configured to operate in a first mode of operation and in a second mode of operation. In the first mode of operation, the own voice activity of the user can be detected by identifying the own voice activity based on the identification criterion. In the second mode of operation, the hearing device can be prepared for the detection of the own voice activity of the user by providing a frequency associated with the own voice characteristic. Providing the frequency associated with the own voice characteristic can comprise deriving the frequency associated with the own voice characteristic by the hearing device. The derived frequency can thus be identified, in particular learned, by the hearing device such that it can then be used for determining said presence of the own voice characteristic at the derived frequency. The derived frequency can be the vibration frequency associated with the own voice characteristic in the vibration signal and/or the audio frequency associated with the own voice characteristic in the audio signal. In some implementations, the derived frequency can be stored in a database, in particular in the second mode of operation of the hearing device, such that it can be retrieved before said determining of said presence of the own voice characteristic at the associated frequency, in particular in the first mode of operation of the hearing device.

In some implementations, the processor is configured to determine a signal feature of the vibration signal and to determine a signal feature of the audio signal. The processor can be configured to determine a similarity measure between the signal feature of the vibration signal and the signal feature of the audio signal. At least one of said determining of the presence of the own voice characteristic in the vibration signal at the associated vibration frequency and said presence of the own voice characteristic in the audio signal at the associated audio frequency can be based on the similarity measure. In some implementations, a threshold value for the similarity measure is provided. In some implementations, after determining the similarity measure larger than the threshold value, at least one of the signal feature of the vibration signal can be identified as the own voice characteristic in the vibration signal and the signal feature of the audio signal can be identified as the own voice characteristic in the audio signal. Thus, at least one of the vibration frequency associated with the own voice characteristic can be identified as the frequency of the signal feature of the vibration signal and the audio frequency associated with the own voice characteristic can be identified as the frequency of the signal feature of the audio signal. In some implementations, the identification criterion further comprises the similarity measure determined larger than the threshold value. In some implementations, the similarity measure can comprise a correlation between the signal feature of the vibration signal and the signal feature of the audio signal, for instance a cross-correlation. In some implementations, the similarity measure can comprise a correlation between the vibration signal and the audio signal. The correlation and/or comparison can be carried out with respect to the frequency associated with the own voice characteristic.

In some implementations, in particular in a first mode of operation of the hearing device in which the own voice activity of the user is detected, employing such a similarity measure can be exploited for an enhanced reliability during detection of the own voice activity. For instance, in a situation in which at least one of the vibration signal and the audio signal includes a rather large signal to noise ratio (SNR), the similarity measure can contribute to an improved identification criterion for the own voice activity which may compensate the poorer quality of at least one of the signals. Thus, a required signal threshold for said determining of the own voice characteristic at the associated frequency may be lowered by employing the similarity measure.

In some implementations, in particular in a second mode of operation of the hearing device in which the hearing device is prepared for the detection of the own voice activity of the user, employing such a similarity measure can be exploited for deriving at least one of said vibration frequency associated with the own voice characteristic in the vibration signal and said audio frequency associated with the own voice characteristic in the audio signal. For instance, when both the associated vibration frequency and the associated audio frequency are unknown, both frequencies may be derived by the similarity measure larger than the threshold value. When one of the associated vibration frequency and the associated audio frequency is unknown, the other frequency may be derived by the similarity measure larger than the threshold value.

In some implementations, the processor is configured to determine the SNR from the audio signal. The processor can be configured to derive at least one of the associated vibration frequency and the associated vibration frequency when the SNR is determined to be smaller than a threshold value. For instance, in a situation in which at least one of the vibration signal and the audio signal includes a rather low SNR, the good quality of the respective signal may be exploited to derive the respective frequency associated with the own voice characteristic based on the similarity measure in the above described way. The derived frequency can thus be used for the own voice detection at a later time by determining said presence of the own voice characteristic at the derived frequency, for instance at a larger SNR of the vibration signal and/or the audio signal. The derived frequency can be stored in a database such that it can be retrieved at the later time for the determining of said presence of the own voice characteristic at the derived frequency associated with the own voice characteristic.

In some implementations, the microphone is communicatively coupled to a beamformer. The processor can be configured to steer a directionality of the beamformer toward a mouth of the user mouth during said detection of the sound. In this way, said part of said sound caused by the own voice activity can be detected in an improved manner. Thus, the audio signal can be provided in a suitable way for an improved reliability of the own voice detection. The microphone can be included in a microphone array communicatively coupled to the beamformer. In some implementations of the binaural hearing system, the second hearing device also comprises a microphone communicatively coupled to the beamformer. By the binaural beamforming, the signal quality of the audio signal can be further improved regarding the own voice detection.

In some implementations, the processor is configured to determine an audio signal characteristic from the audio signal. The audio signal characteristic can comprise a SNR of the audio signal. The identification criterion can further comprise the SNR smaller than a threshold value of the SNR. The audio signal characteristic can comprise an intensity of the audio signal. The identification criterion can further comprise the intensity larger than a threshold value of the intensity.

In some implementations, the processor is configured to determine an intensity of the audio signal and to select at least one of said associated vibration frequency and said associated audio frequency depending on said audio signal intensity. The intensity can be indicative of a volume of said sound detected by the microphone, in particular a volume level. In this way, a frequency shift of the frequency associated with the own voice characteristic at different speech volumes of the user can be accounted for, which can be caused by the "Lombard effect". In some implementations, the processor is configured to determine an intensity of the vibration signal and to select at least one of said associated vibration frequency and said associated audio frequency depending on said audio signal intensity, in order to account for the Lombard effect. In some implementations, in particular in said second mode of operation of the hearing device, the processor is configured to determine an intensity of the audio signal and/or the vibration signal and to derive at least one of said associated vibration frequency and said associated audio frequency. The derived vibration frequency and/or audio frequency can then be employed during own voice detection at varying speech volumes of the user, in particular in said first mode of operation of the hearing device. The processor can be configured to store said determined intensity and said derived vibration frequency and/or audio frequency in a database, in particular in said second mode of operation of the hearing device, and to retrieve the data, in particular in said first mode of operation of the hearing device.

In some implementations, the processor is configured to determine a signal feature of at least one of the vibration signal and the audio signal, and to classify, based on a pattern of own voice characteristics, the signal feature as the own voice characteristic. The processor can be configured to derive at least one of the vibration frequency associated with the own voice characteristic in the vibration signal and the audio frequency associated with the own voice characteristic in the audio signal. In this way, the processor can be configured to learn the associated vibration frequency from the vibration signal and/or the associated audio frequency from the audio signal. In some implementations, in particular in said second mode of operation of the hearing device, the hearing device can thus be prepared for the detection of the own voice activity of the user by providing the derived frequency as the frequency associated with the own voice characteristic. For instance, the derived frequency can be stored in a database in the second mode of operation such that it can be retrieved from the database by the processor in the first mode of operation of the hearing device. In some implementations, in particular in said first mode of operation of the hearing device, the presence of the own voice characteristic can thus be determined at the derived frequency associated with the own voice characteristic and the own voice activity of the user can be detected by identifying the own voice activity based on the identification criterion.

In some implementations, the processor is configured to determine a similarity measure between the signal feature and the pattern of own voice characteristics. The signal feature can be classified as the own voice characteristic if the similarity measure is determined to be larger than a threshold value of the similarity measure. The classification can be provided by a classification algorithm, in particular a classifier, executed by the processor. The classification algorithm can comprise, for instance, a linear classifier such as a Bayes classifier.

The pattern of own voice characteristics can be determined, in particular learned, from a set of own voice characteristics that have been previously determined at an associated frequency, in particular a vibration frequency and/or audio frequency. The set of own voice characteristics can comprise, for instance, own voice characteristics determined from different users, in particular to determine the pattern of own voice characteristics common to the users. The set of own voice characteristics can comprise own voice characteristics determined at various times, in particular to determine the pattern of own voice characteristics over time. The set of own voice characteristics can comprise own voice characteristics determined at different SNR values of the signal, in particular to determine the pattern of own voice characteristics at different SNR values and/or common to different SNR values. The set of own voice characteristics can comprise own voice characteristics determined at various speech volumes of the user, in particular to determine the pattern of own voice characteristics at different speech volumes and/or common to different speech volumes. The latter pattern may be employed, for instance, when determining a presence of an own voice characteristic at the associated frequency at different speech volumes of the user causing a frequency shift by the Lombard effect, as described above. In some implementations, the pattern of own voice characteristics is provided to the processor. In particular, the pattern of own voice characteristics can be stored in a database such that it can be retrieved by the processor from the database. In some implementations, the pattern of own voice characteristics is determined and/or customized by the processor. For instance, the processor can be configured to determine and/or customize the pattern based on classifying the signal characteristic in the above described way. The processor can also be configured to collect the set of own voice characteristics over time and to determine and/or customize the pattern from the set. The determined and/or customized pattern of own voice characteristics can be stored in a database such that it can be retrieved by the processor from the database.

In some implementations, the vibration signal comprises first directional data indicative of a first direction of said part of the vibration caused by the own voice activity, and second directional data indicative of a second direction of said part of the vibration caused by the own voice activity. The first direction can be different from the second direction, for instance perpendicular to the first direction. The processor can be configured to determine said presence of the own voice characteristic in the first directional data and in the second directional data. The identification criterion can further comprise a coincidence, in particular a correlation, of said presence of the own voice characteristic in the first directional data and in the second directional data. This can also contribute to a better own voice detection reliability. The vibration signal can also comprise third directional data indicative of a third direction of said part of the vibration caused by the own voice activity and the processor can be configured to determine said presence of the own voice characteristic in the third directional data. The identification criterion can further comprise a coincidence, in particular a correlation, of said presence of the own voice characteristic in the first, second, and third directional data.

In some implementations, the vibration sensor comprises an accelerometer. Said vibration can be detectable by the accelerometer as an acceleration measurable by the accelerometer. The accelerometer can be configured to detect said vibration in a first spatial direction and a second spatial direction. The accelerometer can thus be configured to provide the vibration signal with said first directional data and said second directional data. The accelerometer can be configured to detect said vibration in a third spatial direction and to provide the vibration signal with said third directional data. For instance, the spatial directions can correspond to the directions of a cartesian coordinate system.

In some implementations, the own voice characteristic comprises a peak of the vibration signal at the associated vibration frequency. The own voice characteristic can be detected at the associated vibration frequency by a peak detection in the vibration signal. In some implementations, the own voice characteristic comprises a minimum signal level of the vibration signal at the associated vibration frequency. The own voice characteristic can be detected by determining the signal level larger than the minimum signal level in the vibration signal at the associated vibration frequency. In some implementations, the own voice characteristic comprises a peak of the audio signal at the associated vibration frequency. The own voice characteristic can be detected at the associated audio frequency by a peak detection in the audio signal. In some implementations, the own voice characteristic comprises a minimum signal level of the audio signal at the associated audio frequency. The own voice characteristic can be detected by determining the signal level larger than the minimum signal level in the audio signal at the associated audio frequency.

In some implementations, the associated vibration frequency comprises a harmonic frequency of said part of the vibration caused by the own voice activity. In particular, the harmonic frequency can be defined as a frequency of a harmonic content of the vibration signal produced by said part of the vibration caused by the own voice activity. For instance, the harmonic frequency can be a frequency of a harmonic content of the vibration signal provided by the accelerometer. The harmonic frequency can comprise the fundamental frequency of said part of the vibration. The harmonic frequency may also comprise a higher harmonic frequency of said part of the vibration, in particular a frequency corresponding to the fundamental frequency multiplied by a positive integer. In some implementations, the processor is configured to select the associated vibration frequency such that it comprises the harmonic frequency, in particular the fundamental frequency, of said part of the vibration. Thus, the own voice detection reliability may be further improved in a manner requiring rather small signal processing. Selecting the fundamental frequency, as compared to a higher harmonic frequency, may provide the least error-prone determination of the own voice characteristic. In some implementations, the associated audio frequency comprises a harmonic frequency of said part of the sound caused by the own voice activity, in particular the fundamental frequency of said part of the sound. In some implementations, the processor is configured to select the associated audio frequency such that it comprises the harmonic frequency of said part of the sound. The harmonic frequency, in particular fundamental frequency, associated with the own voice characteristic may be stored in a database such that it can be retrieved by the processor from the database for determining said presence of the own voice characteristic at the associated frequency. In particular, multiple fundamental frequencies associated with multiple own voice characteristics can be stored in the database.

In some implementations, the associated vibration frequency comprises an alias frequency of a frequency of said part of the vibration caused by the own voice activity. In some implementations, the processor is configured to select the associated vibration frequency such that it comprises said alias frequency. In some implementations, the processor can be configured to process the vibration signal at a sampling rate producing an aliasing of the vibration signal at the alias frequency. In some implementations, the vibration detector can be configured to provide the vibration signal at a sampling rate producing an aliasing of the vibration signal at the alias frequency, in particular when processed by the processor. For instance, the processing rate and/or recording rate can be less than double of a rate corresponding to a vibration frequency which can be mirrored in the vibration signal at the alias frequency. In some implementations, the signal content at the alias frequency is provided by providing the vibration signal to the processor unfiltered at the mirrored frequency. For instance, an anti-aliasing filter, in particular low pass filter, provided at an input of the processor may be configured in such a way and/or may be omitted. In this way, said presence of the own voice characteristic can be determined at higher frequencies associated with the own voice characteristic at the associated alias frequency of the higher frequencies mirrored a lower frequency range. Thus, the recording and/or processing of the vibration signal can be less power intensive and more processing efficient contributing to a reduced complexity of the own voice detection.

In same implementations, a frequency range of a female voice, in particular a frequency range between 150 Hz and 250 Hz, and/or a frequency range of a child's voice, in particular a frequency range between 250 Hz and 650 Hz, is reproduced at a range of alias frequencies in the vibration signal comprising vibration frequencies in a frequency range of a male voice, in particular a frequency range below 150 Hz. In some implementations, the frequency reproduced at the alias frequency in the vibration signal corresponds to a harmonic frequency of said part of the vibration caused by the own voice activity, in particular the fundamental frequency. In some implementations, the associated audio frequency comprises an alias frequency of a frequency of said part of the sound caused by the own voice activity. In some implementations, the processor is configured to select the associated audio frequency such that it comprises said alias frequency. In some implementations, the frequency reproduced at the alias frequency in the audio signal corresponds to a harmonic frequency of said part of the sound caused by the own voice activity, in particular the fundamental frequency. The alias frequency associated with the own voice characteristic may be stored in a database such that it can be retrieved by the processor from the database for determining said presence of the own voice characteristic at the associated alias frequency. In particular, multiple alias frequencies associated with multiple own voice characteristics can be stored in the database.

In some implementations, the processor is configured to evaluate the vibration signal at a sampling rate of at most 1 kHz. In some implementations, the vibration detector is configured to provide the vibration signal at a sampling rate of at most 1 kHz. Such a sampling rate can allow an efficient signal processing such that the own voice detection can be provided in a time efficient manner. In some implementations, such a sampling rate may exploit the aliasing of the associated vibration frequency as described above, in particular for determining a frequency range of a child's voice, to ensure a good reliability of the own voice detection. In some implementations, the processor is configured to evaluate the vibration signal at a sampling rate of at most 500 Hz. In some implementations, the vibration detector is configured to provide the vibration signal at a sampling rate of at most 500 Hz. Thus, the efficiency of the signal processing can be further improved. In some implementations, such a sampling rate may also exploit the aliasing of the associated vibration frequency, in particular for determining a frequency range of a child's voice and/or female voice. In some implementations, the processor is configured to evaluate the audio signal at a sampling rate of at most 1 kHz, in particular at most 500 Hz.

The vibration frequency associated with the own voice characteristic in the vibration signal and/or the audio frequency associated with the own voice characteristic in the audio signal can comprise a frequency bandwidth. In some implementations, the determining the presence of the own voice characteristic comprises simultaneous determining a signal feature and determining of a presence of the signal feature at the frequency bandwidth associated with the own voice characteristic. For instance, the processor can be configured to select the frequency bandwidth and determine the presence of the signal feature at the frequency bandwidth. In some implementations, the determining the presence of the own voice characteristic comprises determining a signal feature and subsequent determining of a presence of the signal feature at said frequency bandwidth. For instance, the processor can be configured to determine the presence of the signal feature and subsequently select the frequency bandwidth and determine the signal feature present at the frequency bandwidth. In some implementations, the frequency bandwidth corresponds to a width of at most 50 Hz, in particular at most 20 Hz. This can improve the reliability of the own voice detection, in particular in conjunction with a speech recognition of the user's voice.

In some implementations, the hearing device further comprises a high pass filter configured to provide the vibration signal with vibration frequencies above a cut-off frequency of at most 100 Hz, in particular at most 80 Hz. In this way, the vibration signal can be provided to the processor with a signal content in which signal artefacts, in particular artefacts of vibrations caused by a body movement of the user, are removed. Thus, the own voice detection reliability can be enhanced. In some implementations, the high pass filter is configured to provide the vibration signal to the processor with vibration frequencies above a cut-off frequency of at most 50 Hz, in particular at most 30 Hz. Such a range of vibration frequencies provided by the high pass filter can have the additional advantage to exploit the above described aliasing effect during said determining of the own voice characteristic by still allowing to remove artefacts caused by a body movement of the user. In some implementations, the cut-off frequency is at least 1 Hz.

In some implementations, the hearing device further comprises a low pass filter configured to provide said audio signal with audio frequencies below a cut-off frequency of at most 8 kHz, in particular at most 4 kHz. In this way, the audio signal can be provided to the processor with a signal content adjusted to the own voice detection, in particular to improve the own voice detection reliability and/or a speech recognition, wherein a variety of own voice characteristics related to vocals, consonants, keywords etc. may be distinguishable. In some implementations, the low pass filter is configured to provide the vibration signal to the processor with vibration frequencies below a cut-off frequency of at most 1 kHz, in particular at most 500 Hz. Such a configuration can be particularly advantageous for own voice detection in noisy environments.

In some implementations, the processor is configured to provide a speech recognition of the user during the own voice activity. The speech recognition can be based on said identification criterion including said determined presence of said own voice characteristic at the associated frequency. The determined own voice characteristic may thus be allocated to a speech component of the user, and recognized based on the allocation. The determined own voice characteristic may also be allocated to a speech component of the user which has been recognized by another speech recognition method, and confirmed or not confirmed based on this allocation, to increase the reliability of the speech recognition. In some implementations, in particular for said speech recognition, the processor is configured to recognize, based on the identification criterion, at least one of a word and a phrase spoken by the user during said own voice activity.

In some implementations, the associated vibration frequency is selected such that the own voice characteristic is representative for a speech component characteristic of said own voice activity. In some implementations, the speech component comprises at least one of a vowel, a consonant, a voiced phoneme, an unvoiced phoneme, a syllable, and a word rate spoken by the user during the own voice activity. In some implementations, the processor is configured to select the associated vibration frequency such that it corresponds to a selected speech component, for instance at least one vowel spoken by the user. The associated vibration frequency corresponding to the selected speech component can be user specific. Such an associated vibration frequency may be derived from the processor, in particular learned by the processor, for instance in any of the above described ways. In some implementations, the processor is configured to select the associated vibration frequency from a set of associated vibration frequencies each corresponding to a different speech component, for instance a different vowel spoken by the user.

In some implementations of the binaural hearing system, the second hearing device comprises an additional vibration sensor configured to detect said vibration and to output an additional vibration signal comprising information about said vibration. Said identification criterion can further comprise a coincidence, in particular a correlation, of said presence of the own voice characteristic in the vibration signal of the first hearing device and in the additional vibration signal of the second hearing device at the associated vibration frequency. In some implementations of the binaural hearing system, the second hearing device comprises an additional microphone configured to detect said sound, and to output an additional audio signal comprising information about said sound. Said identification criterion can further comprise a coincidence, in particular a correlation, of said presence of the own voice characteristic in the audio signal of the first hearing device and in the additional audio signal of the second hearing device at the associated audio frequency.

BRIEF DESCRIPTION OF THE DRAWINGS

Reference will now be made in detail to embodiments, examples of which are illustrated in the accompanying drawings. The drawings illustrate various embodiments and are a part of the specification. The illustrated embodiments are merely examples and do not limit the scope of the disclosure. Throughout the drawings, identical or similar reference numbers designate identical or similar elements. In the drawings.

DETAILED DESCRIPTION OF THE DRAWINGS

Figure 1:
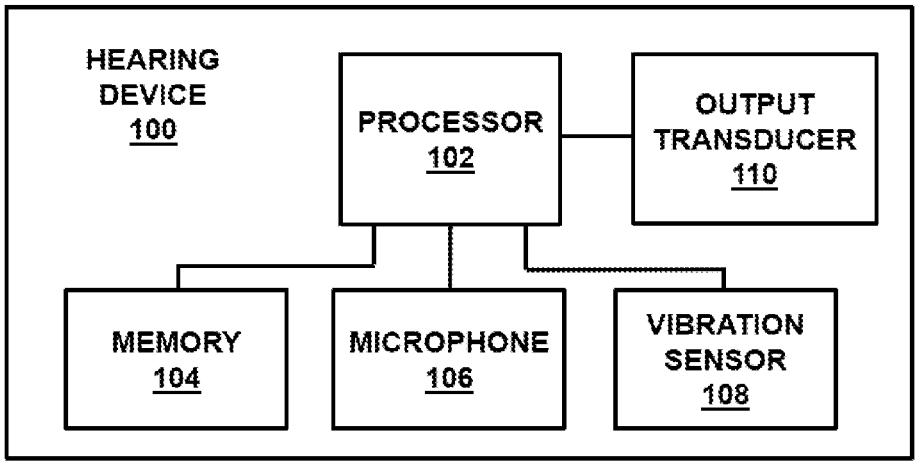
FIG. 1 schematically illustrates an exemplary hearing device including a vibration sensor, a processor, a memory, an output transducer, and a microphone, in accordance with some embodiments of the present disclosure.

Referring to FIG. 1, a hearing device 100 according to some embodiments of the present disclosure is illustrated. As shown, hearing device 100 includes a processor 102 communicatively coupled to a memory 104, a microphone 106, a vibration sensor 108, and an output transducer 110. Hearing device 100 may include additional or alternative components as may serve a particular implementation.

Hearing device 100 may be implemented by any type of hearing device configured to enable or enhance hearing of a user wearing hearing device 100. For example, hearing device 100 may be implemented by a hearing aid configured to provide an amplified version of audio content to a user, an earphone, a cochlear implant system configured to provide electrical stimulation representative of audio content to a user, a sound processor included in a bimodal hearing system configured to provide both amplification and electrical stimulation representative of audio content to a user, or any other suitable hearing prosthesis. Different types of hearing devices can also be distinguished by the position at which a housing accommodating output transducer 100 is intended to be worn at a head of a user relative to an ear canal of the user. Hearing devices which are configured such that the housing enclosing the transducer can be worn at a wearing position outside the ear canal, in particular behind an ear of the user, can include, for instance, behind-the-ear (BTE) hearing aids. Hearing devices which are configured such that the housing enclosing the transducer can be at least partially inserted into the ear canal can include, for instance, earbuds, earphones, and hearing instruments such as receiver-in-the-canal (RIC) hearing aids, in-the-ear (ITE) hearing aids, invisible-in-the-canal (IIC) hearing aids, and completely-in-the-canal (CIC) hearing aids. The housing can be an earpiece adapted for an insertion and/or a partial insertion into the ear canal. Some hearing devices comprise a housing having a standardized shape intended to fit into a variety of ear canals of different users. Other hearing devices comprise a housing having a customized shape adapted to an ear canal of an individual user. The customized housing can be, for instance, a shell formed from an ear mould or an earpiece that is customizable in-situ by the user.

Microphone 106 may be implemented by any suitable audio detection device and is configured to detect a sound presented to a user of hearing device 100. The sound can comprise audio content (e.g., music, speech, noise, etc.) generated by one or more audio sources included in an environment of the user. The sound can also include audio content generated by a voice of the user during an own voice activity, such as a speech by the user. In particular, a vibration of the user's vocal chords during the own voice activity may produce airborne sound in the environment of the user, which is detectable as the audio signal by microphone 106. Microphone 106 is configured to output an audio signal comprising information about the sound detected from the environment of the user. Microphone 106 may be included in or communicatively coupled to hearing device 100 in any suitable manner. Output transducer 110 may be implemented by any suitable audio output device, for instance a loudspeaker of a hearing device or an output electrode of a cochlear implant system.

Vibration sensor 108 may be implemented by any suitable sensor configured to detect a vibration conducted during an own voice activity through the user's head. In particular, the vibrations can be conducted from the user's vocal chords through the bones and tissue of the head. In some implementations, sensor 108 may also be referred to as a bone vibration sensor. Vibration sensor 108 is configured to output a vibration signal comprising information about the detected vibrations. Vibration sensor 108 may be positioned at any position at the user's head allowing the detection of the vibrations conducted through the head. In some implementations, vibration sensor 108 can be positioned behind an ear of the user. For instance, vibration sensor 108 can be included in a part of a BTE or RIC hearing aid intended to be worn behind the user's ear. In some implementations, vibration sensor 108 can be positioned inside an ear canal of the user. For instance, vibration sensor 108 can be included in a part of an earbud or of a MC or ITE or IIC or CIC hearing aid intended to be worn inside the ear canal.

In some implementations, vibration sensor 108 can be included inside a housing of the hearing device. The vibrations can be transmitted from the user's head through the housing to vibration sensor 108. In some implementations, vibration sensor 108 can be provided externally from a housing of the hearing device. In particular, vibration sensor 108 can be provided at a head surface, for instance behind the ear or inside the ear canal, to directly pick up the vibrations from the users head. Thus, while hearing device 100 is being worn by a user, the detected vibrations are representative of the own voice activity. In some implementations, vibration sensor 108 comprises an inertial sensor, in particular an accelerometer and/or a gyroscope. The inertial sensor can be positioned inside the ear canal or at a different position at the user's head. In some implementations, vibration sensor 108 comprises a bone conductive microphone and/or a pressure sensor and/or a strain gauge to be positioned inside an ear canal as disclosed in European patent application No. EP 18195686.3, which is herewith included by reference. In some implementations, vibration sensor 108 comprises an optical sensor employing a light emitter, such as a laser diode or a LED, and a photodetector to detect the vibrations, as disclosed in U.S. patent application publication Nos. US 2018/0011006 A1 and US 2018/0011006 A1, which are herewith included by reference.

In some implementations, vibration sensor 108 is configured to output the vibration signal while microphone 106 outputs the audio signal. Both, the vibration signal and the audio signal can be representative of the own voice activity. For example, the audio signal may represent audio content generated, on the one hand, by one or more audio sources included in an environment and, on the other hand, by the own voice activity, while the vibration signal may represent vibrations mostly generated by the own voice activity. As another example, the vibration signal may contain additional artefacts caused, for instance, by a movement of the user and/or impacts from the environment.

Memory 104 may be implemented by any suitable type of storage medium and may be configured to maintain (e.g., store) data generated, accessed, or otherwise used by processor 102. For example, memory 104 may maintain data representative of an own voice processing program that specifies how processor 102 processes the vibration signal and/or the audio signal. Memory 104 may also be used to maintain a database including data representative of parameters that are employed for the own voice detection. To illustrate, memory 104 may maintain data associated with own voice characteristics that can be representative for an own voice activity in the vibration signal provided by vibration sensor 108 and/or in the audio signal provided by microphone 106. The data may include values of a vibration frequency of the vibration signal and/or values of an audio frequency of the audio signal which are associated with a respective own voice characteristic in the vibration signal and/or audio signal.

Processor 102 may be configured to access the vibration signal generated by vibration sensor 108 and/or the audio signal generated by microphone 106. Processor 102 may use the vibration signal and/or the audio signal to identify an own voice activity of the user. For example, processor 102 may be configured to determine a presence of an own voice characteristic in the vibration signal at a vibration frequency associated with an own voice characteristic, and to identify the own voice activity based on an identification criterion comprising said determined presence of the own voice characteristic in the vibration signal at the associated vibration frequency. As another example, processor 102 may determine a presence of an own voice characteristic in the audio signal at an audio frequency associated with the own voice characteristic, and to identify the own voice activity based on an identification criterion comprising said determined presence of the own voice characteristic in the audio signal at the associated audio frequency. These and other operations that may be performed by processor 102 are described in more detail in the description that follows. References to operations performed by hearing device 100 may be understood to be performed by processor 102 of hearing device 100.

Figure 2:
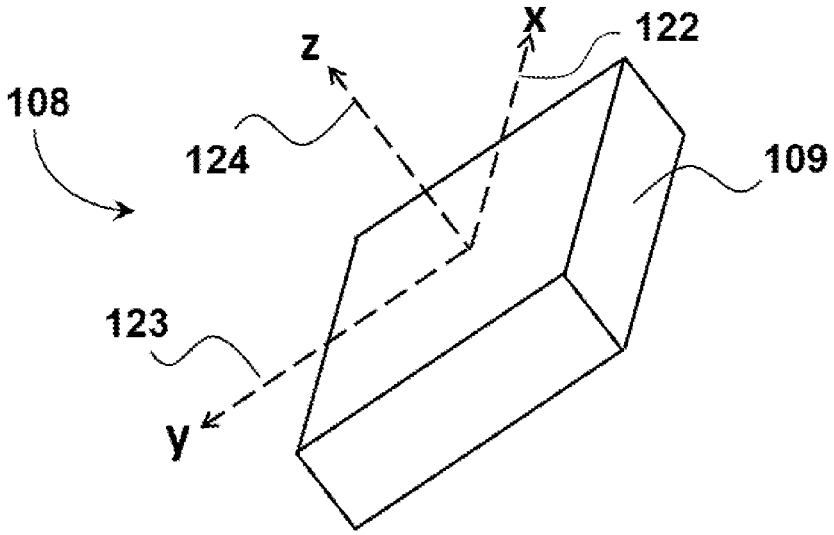
FIG. 2 schematically illustrates an accelerometer which can be applied in the hearing device shown in FIG. 1 as an example of the vibration sensor, in accordance with some embodiments of the present disclosure.

FIG. 2 illustrates vibration sensor 108 in accordance with some embodiments of the present disclosure. Vibration sensor 108 is provided by an accelerometer 109 which may be configured to detect accelerations in one, two, or three distinct spatial directions. In the illustrated example, accelerometer 109 is configured to detect accelerations in three spatial directions including an x-direction 122, a y-direction 123, and a z-direction 124. When positioned at a user's head, accelerometer 109 is thus configured to provide a respective vibration signal indicative of vibrations caused by an own voice activity in each of spatial directions 122-124.

Figure 3A:
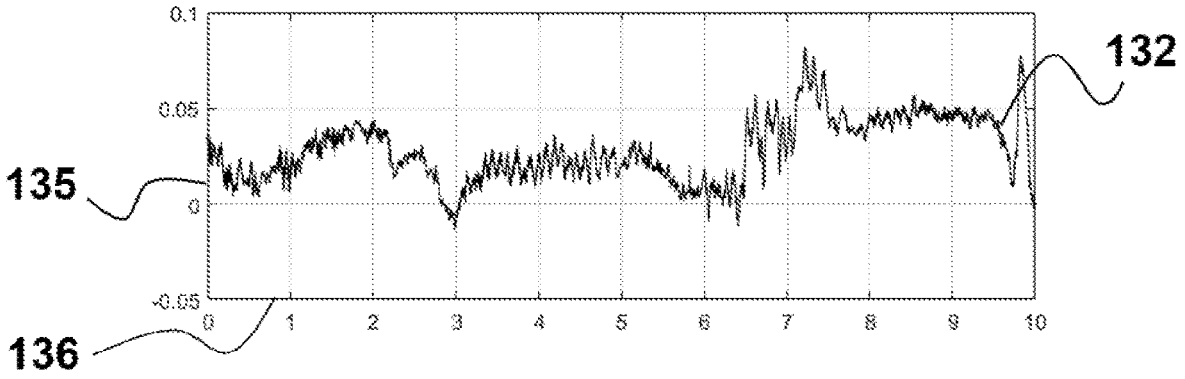
FIGS. 3A-3C illustrate exemplary vibration signals which can be provided by the vibration sensor illustrated in FIG. 2, in accordance with some embodiments of the present disclosure.
Figure 3B:
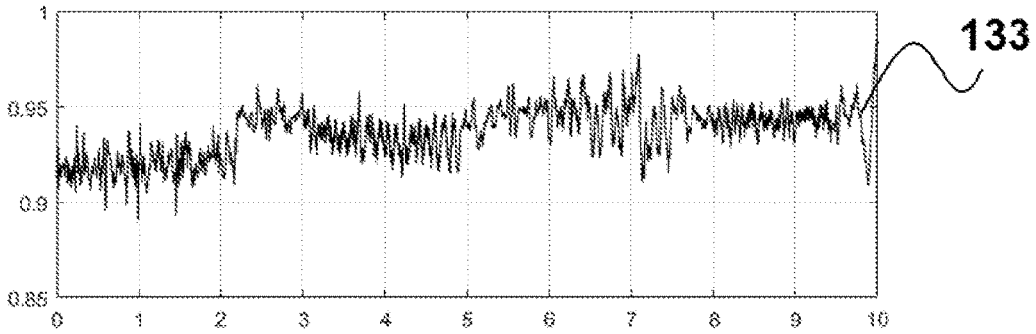
Figure 3C:
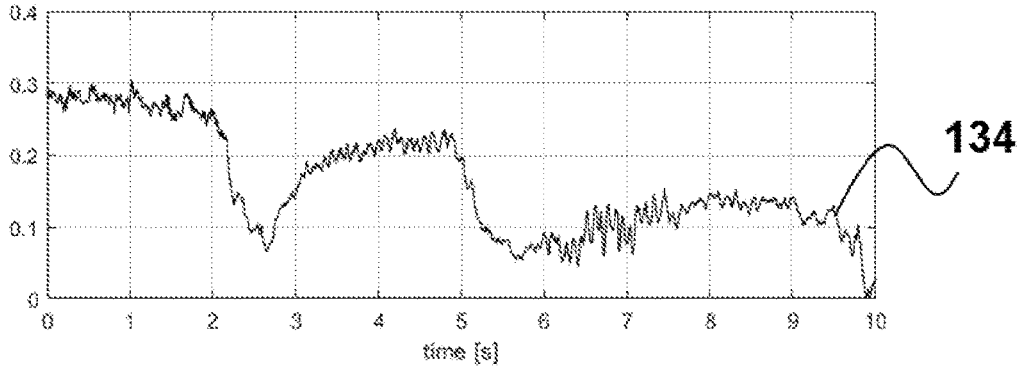

FIGS. 3A-3C show examples of vibration signals 132, 133, 134 recorded (e.g., sampled) by vibration sensor 108 implemented by an accelerometer 109, as illustrated in FIG. 2, over time, wherein the accelerometer has been positioned at a user's head during an own voice activity. Vibration signal 132 depicted in FIG. 3A represents detected vibrations in x-direction 122, vibration signal 133 depicted in FIG. 3B represents detected vibrations in y-direction 123, vibration signal 134 depicted in FIG. 3B represents detected vibrations in z-direction 124. Vibration signals 132-134 are depicted in a respective functional plot. Each functional plot comprises an axis of ordinates 135 indicating a signal level of the recorded vibration signal, and an axis of abscissas 136 indicating a time during which the vibration signal has been recorded. Vibration signals 132-134 have been recorded during the same time period. The duration of the time period (e.g., sampling time) was 10 seconds. In the example, vibrations caused by an own voice activity of a user have been recorded at a sampling rate of 250 Hz. During the own voice activity, the user has subsequently pronounced three different vowels. The vibrations caused by speaking of the first vowel have been recorded during a time corresponding to approximately the initial three seconds in the functional plots of vibration signals 132-134. The recorded vibrations related of the second vowel correspond to approximately the subsequent three seconds in the functional plots. The recorded vibrations related of the third vowel correspond to approximately the last three seconds in the functional plots.

Figure 4A:
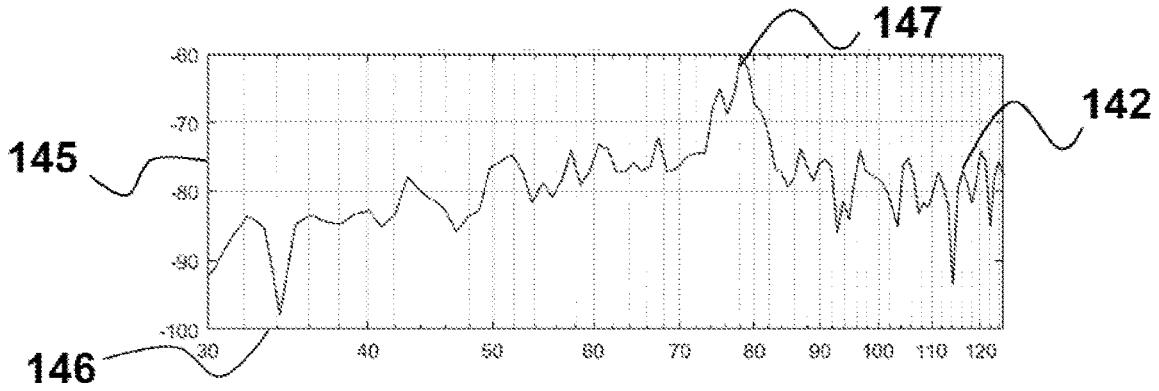
FIGS. 4A-4C illustrate exemplary frequency spectra which can be obtained from the vibration signals illustrated in FIGS. 3A-3C, in accordance with some embodiments of the present disclosure.
Figure 4B:
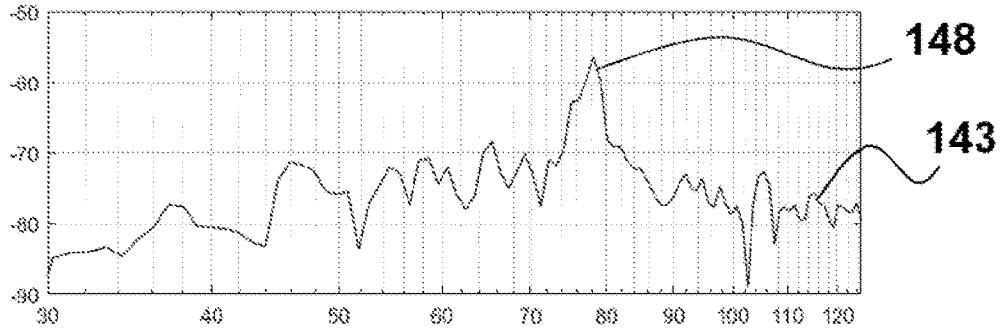
Figure 4C:
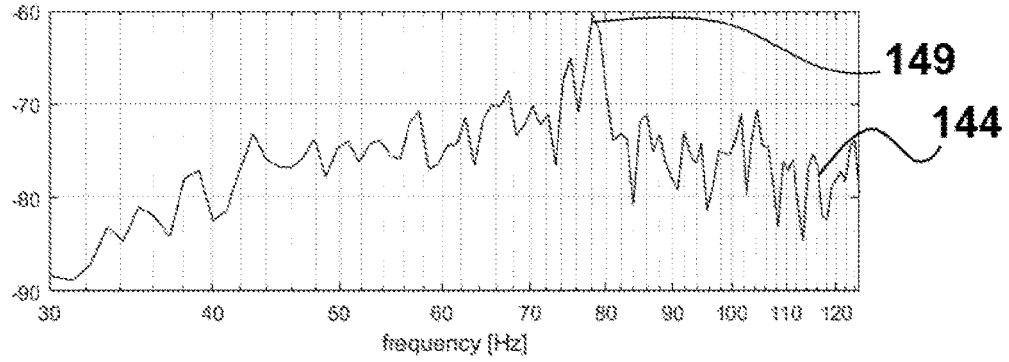

FIGS. 4A-4C show frequency spectra 142, 143, 144 obtained from vibration signals 132, 133, 134. Frequency spectra 142, 143, 144 have been obtained by evaluating a first temporal section of time dependent vibration signals 132, 133, 134 in a frequency domain. The first temporal section corresponds to a signal portion recorded during the initial three seconds in the functional plots of vibration signals 132-134 depicted in FIGS. 3A-3C. Thus, frequency spectra 142-144 are indicative of the vibrations caused by the first vowel pronounced by the user. Frequency spectrum 142 depicted in FIG. 4A has been obtained from the first temporal section of vibration signal 132, frequency spectrum 143 depicted in FIG. 4B has been obtained from the first temporal section of vibration signal 133, and frequency spectrum 144 depicted in FIG. 4C has been obtained from the first temporal section of vibration signal 134. Frequency spectrum 142 is thus indicative of the detected vibrations in x-direction 122, frequency spectrum 143 is indicative of the detected vibrations in y-direction 123, and frequency spectrum 144 is indicative of the detected vibrations in z-direction 124. Frequency spectra 142-144 are depicted in a respective functional plot. Each functional plot comprises an axis of ordinates 145 indicating a signal level of the recorded vibration signal, and an axis of abscissas 146 indicating a vibration frequency associated with the signal level. In the example, frequency spectra 142-144 are provided as the power spectral density (PSD) of the first temporal section of time dependent vibration signals 132-134. Before obtaining frequency spectra 142-144, vibration signals 132-134 have been frequency filtered by a high pass filter.

Signal features produced in vibration signals 132-134 by the own voice activity can be visualized in frequency spectra 142-144. In the example, such a signal feature of vibration signals 132-134 produced by the pronunciation of the first vowel can be seen as a peak 147, 148, 149 visible in frequency spectra 142-144 at an associated vibration frequency of approximately 78 Hz. Signal features 147-149 each are indicative of the vibration caused by the own voice activity and thus correspond to an own voice characteristic. Own voice characteristic 147-149 is produced in each vibration signal 132-134 for the different spatial directions 122-124. Determining a presence of the own voice characteristic in vibration signals 132-134 at the associated vibration frequency can thus be exploited to provide an identification criterion for the own voice activity. On the one hand, such an identification criterion can facilitate the own voice detection, in particular to allow a faster detection. On the other hand, such an identification criterion can increase the reliability of the own voice detection, in some implementations also in conjunction with additional requisites satisfying the identification criterion.

Figure 5A:
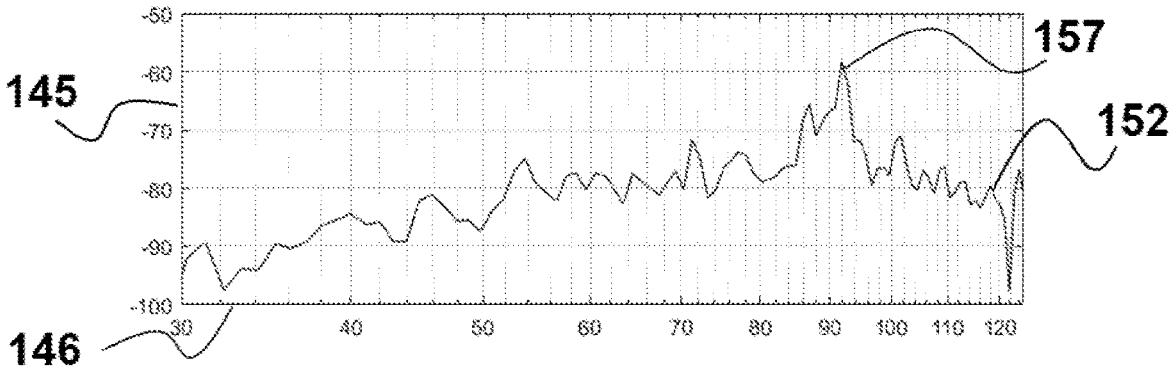
FIGS. 5A-5C illustrate further exemplary frequency spectra which can be obtained from the vibration signals illustrated in FIGS. 3A-3C, in accordance with some embodiments of the present disclosure.
Figure 5B:
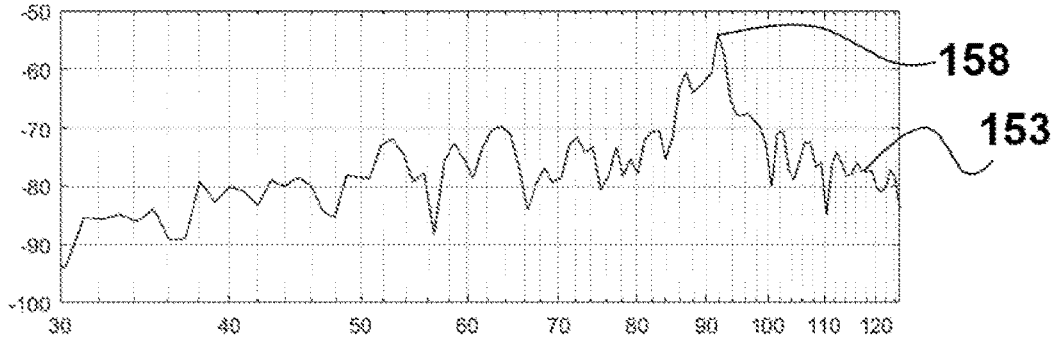
Figure 5C:
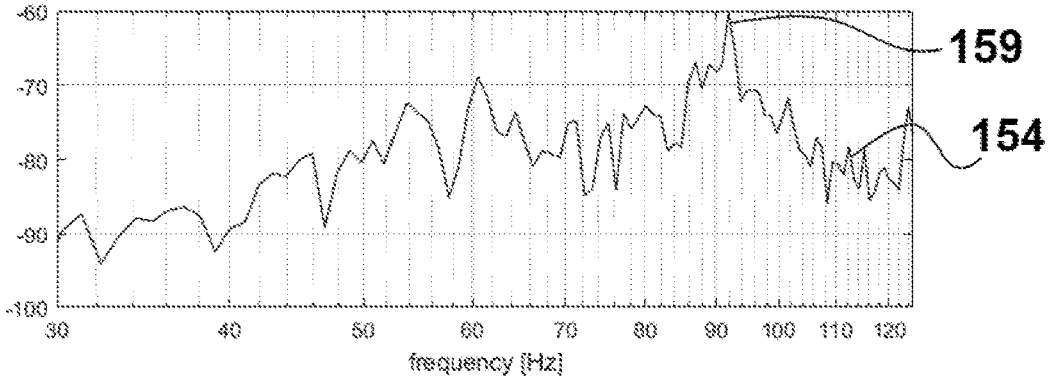

FIGS. 5A-5C show functional plots of further frequency spectra 152, 153, 154. Frequency spectra 152-154 were obtained by evaluating a second temporal section of time dependent vibration signals 132, 133, 134 in a frequency domain. The second temporal section corresponds to a signal portion recorded within the third and sixth second in the functional plots of vibration signals 132-134 depicted in FIGS. 3A-3C. Thus, frequency spectra 152-154 are indicative of the vibrations caused by the second vowel pronounced by the user. Frequency spectrum 152 depicted in FIG. 5A has been obtained from the second temporal section of vibration signal 132, frequency spectrum 153 depicted in FIG. 5B has been obtained from the second temporal section of vibration signal 133, and frequency spectrum 154 depicted in FIG. 5C has been obtained from the second temporal section of vibration signal 134. Frequency spectrum 152 is thus indicative of the vibrations in x-direction 122, frequency spectrum 153 is indicative of the vibrations in y-direction 123, and frequency spectrum 154 is indicative of the vibrations in z-direction 124.

Signal features produced in vibration signals 132-134 by the pronunciation of the second vowel can be seen in frequency spectra 152-154 as a spectral peak 157, 158, 159. Signal features 157-159 each are indicative of the vibration caused by the own voice activity and thus each correspond to an own voice characteristic. The vibration frequency associated with own voice characteristics 157-159 is approximately 92 Hz in each vibration signal 132-134 for the different spatial directions 122-124. The vibration frequency associated with own voice characteristics 147-149 produced in vibration signals 132-134 by the pronunciation of the first vowel thus differs from the vibration frequency associated with own voice characteristics 157-159 produced in vibration signals 132-134 by the pronunciation of the second vowel. This shows that the vibration frequency associated with the own voice characteristics produced in vibration signals 132-134 can depend on the content of the own voice activity, in particular the content of the user's speech. Moreover, the vibration frequency associated with the own voice characteristics generally can also depend on properties of the user. For instance, different voices of different users generally may produce an own voice characteristics associated with a different vibration frequency in the vibration signal, in particular for an own voice activity including the same content. Moreover, different speech volumes of the own voice activity, for instance when the user speaks louder due to noise occurring in the environment, can lead to a frequency shift of the vibration frequency associated with the own voice characteristic. The later phenomenom is also known as the "Lombard effect". An own voice detection relying on an identification criterion comprising a presence of the own voice characteristic in vibration signals 132-134 may thus account for the occurring variations of the vibration frequency associated with the own voice characteristic in order to increase the detection reliability. Some embodiments of hearing device 100 and methods of its operation, which allow to employ such an identification criterion for own voice detection at varying vibration frequencies associated with the own voice characteristic, are addressed in the subsequent description.

FIGS. 6-13 illustrate exemplary methods of operating a hearing device according to some embodiments of the present disclosure. Other embodiments may omit, add to, reorder and/or modify any of the operations shown in FIGS. 6-13. Some embodiments may be implemented in hearing device 100 illustrated in FIG. 1. Some embodiments may be implemented in a hearing device comprising additional constituent parts, for instance an additional microphone and/or a beamformer. Some embodiments may be implemented in a hearing system comprising two hearing devices in a binaural configuration.

Figure 6:
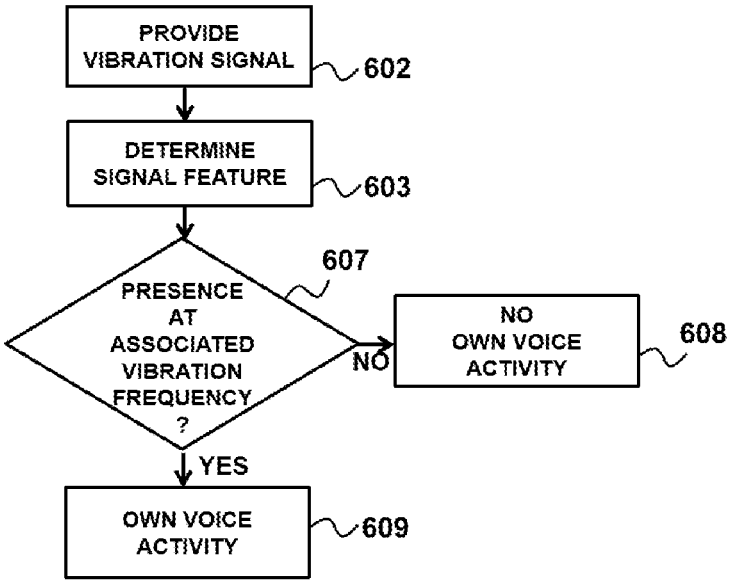
FIGS. 6-13 illustrate exemplary methods of own voice detection that may be executed by the hearing device illustrated in FIG. 1, in accordance with some embodiments of the present disclosure.

In the method illustrated in FIG. 6, a vibration signal indicative of a vibration caused by an own voice activity of a user is provided in operation 602. The vibration signal can be provided, for instance, by vibration sensor 108 after detection of the vibration conducted through the user's head. In operation 603, a signal feature is determined in the vibration signal. The signal feature can be produced in the vibration signal by the own voice activity. The signal feature can be a frequency dependent property of the vibration signal such that it is characteristic for a specific vibration frequency. The signal feature can comprise a peak at the vibration frequency. To illustrate, the signal feature may be provided as at least one of peaks 147-149 and/or at least one of peaks 157-159 produced in vibration signals 132-134. Alternatively or additionally, the signal feature can comprise another property, for instance a signal level larger than a specified minimum level at the vibration frequency.

The determining the signal feature can comprise a peak detection in the vibration signal. In some implementations, the vibration signal can be evaluated in a frequency domain comprising a spectrum of vibration frequencies in order to determine the signal feature. This may imply converting a time dependent vibration signal from a time domain into the frequency domain. In some implementations, the signal feature can be determined directly from a time dependent vibration signal. To illustrate, at least one of peaks 147-149 and/or at least one of peaks 157-159 produced in vibration signals 132-134 at an associated vibration frequency may be extracted after converting at least a temporal section of vibration signals 132-134 from the time domain into the frequency domain, as illustrated in FIGS. 4A-4C and FIGS. 5A-5C, and/or the respective peak may be extracted directly from time dependent vibration signals 132-134.

In operation 607, a decision is performed depending on an identification criterion. The identification criterion can be based on whether the signal feature is determined to be present in the vibration signal at a vibration frequency associated with an own voice characteristic. The signal feature can thus be identified as the own voice characteristic which is determined to be present at the associated vibration frequency. In some implementations, determining the presence of the own voice characteristic at the associated vibration frequency comprises simultaneous determining the signal feature in the vibration signal and determining the presence of the signal feature at the vibration frequency associated with the own voice characteristic in operation 603. In particular, the vibration signal can be evaluated at the associated vibration frequency with respect to the presence of the signal feature which is thus identified as the own voice characteristic. In some implementations, the presence of the own voice characteristic at the associated vibration frequency comprises the operations of determining the signal feature in operation 603, and subsequently determining the presence of the signal feature at the vibration frequency associated with the own voice characteristic. For instance, the vibration signal can be evaluated for any vibration frequency or a plurality of vibration frequencies with respect to the presence of the signal feature and then it can be determined if a vibration frequency at which the signal feature is present corresponds to the vibration frequency associated with the own voice characteristic. To illustrate, vibration signals 132-134 may be evaluated at the vibration frequency associated with at least one of peaks 147-149 and/or at least one of peaks 157-159 in order to determine the presence of the respective peak at the associated vibration frequency, and/or vibration signals 132-134 may be first evaluated with respect to the presence of at least one of peaks 147-149 and/or at least one of peaks 157-159 and then it may be determined if the respective peak is present at the associated vibration frequency.

The vibration frequency associated with the own voice characteristic can comprise a frequency bandwidth. The frequency bandwidth can be selected such that it accounts for inaccuracies and/or variances of a value of the vibration frequency occurring during the detection of the vibration. In some implementations, the frequency bandwidth can be selected such that it is associated with a plurality of own voice characteristics. To illustrate, the vibration frequency can be a frequency bandwidth comprising the vibration frequency associated with at least one of peaks 147-149 and the vibration frequency associated with at least one of peaks 157-159 produced in vibration signals 132-134. The own voice activity may thus be identified depending on at least one of the own voice characteristics determined to be present at the associated vibration frequency. In some implementations, the frequency bandwidth can be selected such that it is associated with a single own voice characteristic. To illustrate, the vibration frequency associated with one own voice characteristic can be a frequency bandwidth comprising the vibration frequency associated with at least one of peaks 147-149 produced in vibration signals 132-134 and not comprising the vibration frequency associated with at least one of peaks 157-159 produced in vibration signals 132-134. The vibration frequency associated with another own voice characteristic can be a frequency bandwidth comprising the vibration frequency associated with at least one of peaks 157-159 produced in vibration signals 132-134 and not comprising the vibration frequency associated with at least one of peaks 147-149 produced in vibration signals 132-134. The own voice activity may thus be identified depending on the respective own voice characteristic determined to be present at the associated vibration frequency.

Depending on the outcome of the decision performed in operation 607, a non-occurring own voice activity of the user is identified in operation 608, if the own voice characteristic has not been determined to be present in the vibration signal at the vibration frequency associated with the own voice characteristic. Conversely, an occurrence of an own voice activity of the user is identified in operation 609, if the own voice characteristic has been determined to be present in the vibration signal at the associated vibration frequency.

Figure 7:
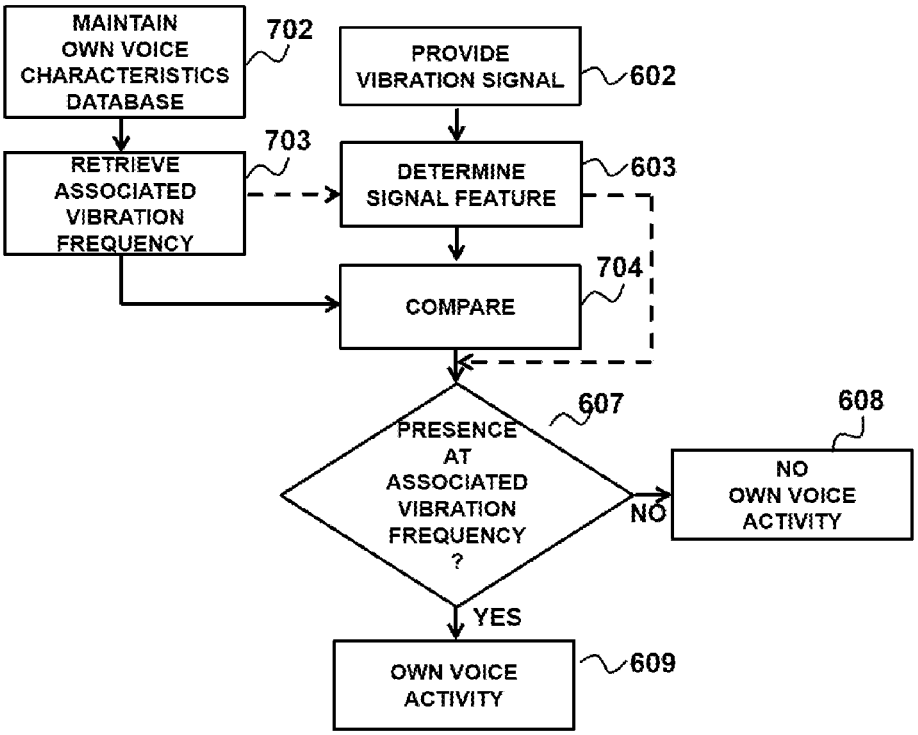

FIG. 7 illustrates another method of operating a hearing device for detection of an own voice activity of the user according to some embodiments of the present disclosure. In operation 702, data relative to at least one own voice characteristic or a plurality of own voice characteristics is maintained in a database. The data comprises the vibration frequency associated with the own voice characteristic. The data can be stored in memory 104 and/or processed by processor 102. In operation 703, at least one vibration frequency associated with at least one own voice characteristic is retrieved from the data. Operations 702 and 703 can be performed concurrently with providing a vibration signal in operation 602 and/or determining the signal feature in operation 603. In some implementations, an operation 704 can be performed after determining the signal feature in operation 603. In operation 704, the vibration frequency associated with the own voice characteristic, which has been retrieved in operation 703, is compared with the vibration frequency at which the signal feature, as determined in operation 603, is present. The comparison in operation 704 can then be employed in the decision in operation 607 depending on whether the signal feature identified as the own voice characteristic is present in the vibration signal at the vibration frequency associated with the own voice characteristic. In some implementations, the vibration frequency associated with the own voice characteristic, which has been retrieved in operation 703, can be applied during determining the signal feature in operation 603, as indicated by a dashed arrow in FIG. 7. In particular, the vibration signal can be directly evaluated at the associated vibration frequency, which has been retrieved in operation 703, with respect to the presence of the signal feature at the vibration frequency associated with the own voice characteristic. The comparison in operation 704 may then be omitted. The evaluation of the vibration signal at the associated vibration frequency can be employed in the decision in operation 607 depending on whether the own voice characteristic is present in the vibration signal at the vibration frequency associated with the own voice characteristic.

Figure 8:
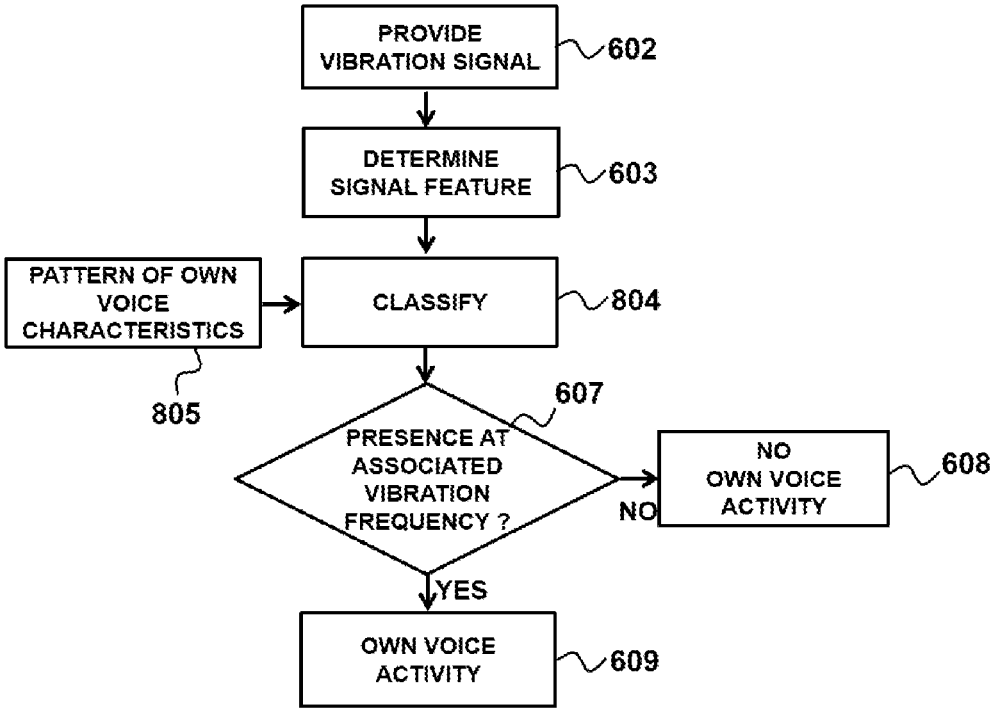

FIG. 8 illustrates another method of operating a hearing device for detection of an own voice activity of the user according to some embodiments of the present disclosure. An operation 804 is performed after determining the signal feature in operation 603. In operation 804, the signal feature determined in operation 603 is classified based on a pattern of own voice characteristics. Before or during operation 804, the pattern of own voice characteristics is provided in operation 805. For instance, the pattern of own voice characteristics can be retrieved by processor 102 from a database, for instance a database stored in memory 104. The classification in operation 804 can comprise determining a similarity measure between the signal feature determined in operation 603 and the pattern of own voice characteristics provided in operation 805. In particular, the signal feature can be classified in operation 804 as the own voice characteristic if the similarity measure is determined to be larger than a threshold value of the similarity measure. For instance, a vibration frequency at which the signal feature determined in operation 603 is present can be determined to exceed the threshold value of the similarity measure with respect to the pattern of own voice characteristics provided in operation 805. For instance, a signal level of the signal feature determined in operation 603 can be determined to exceed the threshold value of the similarity measure with respect to the pattern of own voice characteristics provided in operation 805. For instance, a characteristic of an audio signal indicative of a sound that has been detected simultaneously with the vibration producing the signal feature determined in operation 603 can be determined to exceed the threshold value of the similarity measure with respect to the pattern of own voice characteristics provided in operation 805. The signal feature can thus be classified as the own voice characteristic determined to be present at the associated vibration frequency. In some implementations, the pattern of own voice characteristics provided in operation 805 can then be customized by processor 102 such that it includes new information regarding the signal feature classified as the own voice characteristic. Subsequently, the customized pattern of own voice characteristics may be stored in the database such that the pattern including the new information can be retrieved in future executions of operation 805. In this way, processor 102 can be configured to learn the own voice characteristics and the associated vibration frequency. A corresponding classifier can be operable by processor 102. The classification can be based, for instance, on a Bayesian analysis and/or other classification schemes.

Figure 9:
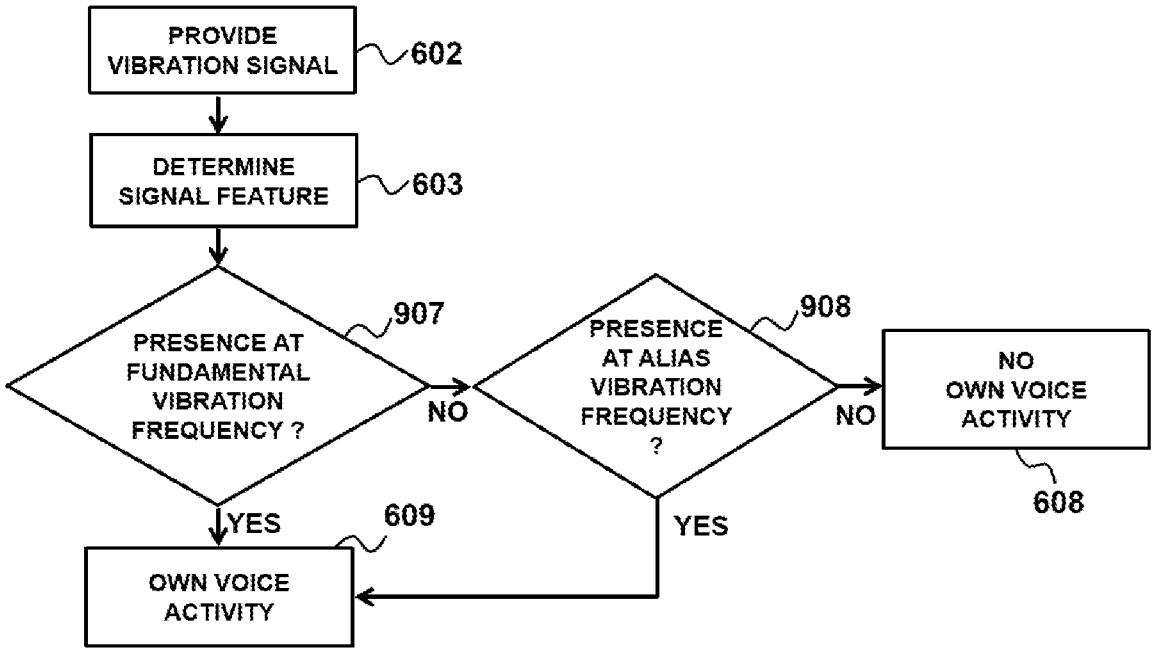

FIG. 9 illustrates another method of operating a hearing device for detection of an own voice activity of the user according to some embodiments of the present disclosure. In the place of the decision in operation 607, two decisions are performed in operations 907 and 908. The decision in operation 907 substantially corresponds to the decision in 607, wherein the vibration frequency associated with the own voice characteristic is selected as a fundamental frequency of the vibration caused by the own voice activity. The decision in operation 908 substantially corresponds to the decision in 607, wherein the vibration frequency associated with the own voice characteristic is selected as an alias frequency of the fundamental frequency of the vibration caused by the own voice activity. In some implementations, the determining the presence of the own voice characteristic at the fundamental vibration frequency and/or at the alias vibration frequency of the fundamental vibration frequency comprises simultaneous determining of the signal feature in operation 603. In some implementations, the presence of the own voice characteristic at the fundamental vibration frequency and/or at the alias vibration frequency is determined by determining the signal feature in operation 603 and then determining the presence of the signal feature at the fundamental vibration frequency and/or at the alias vibration frequency.

To illustrate, the own voice characteristic can be produced in the vibration signal at an alias frequency of the fundamental frequency by employing a sampling rate causing an aliasing effect. Vibration sensor 108 can be configured to record the vibrations caused by the own voice activity at this sampling rate and/or to provide the vibration signal at this sampling rate. To this end, vibration sensor 108 may be configured to sample the vibrations from an analog input without applying an anti-aliasing filter (e.g. low pass filter) in between. Vibration sensor 108 can thus be configured to produce the own voice characteristic in the vibration signal at the fundamental vibration frequency and/or at the alias vibration frequency, in particular such that anti-aliasing components can be produced in the vibration signal. Determining the presence of the own voice characteristic at the alias vibration frequency can have the advantage to allow vibration sensor 108 to operate at a lower sampling rate than the Nyquist rate. This can allow determining the presence of an own voice characteristic in the vibration signal exhibiting a fundamental frequency beyond the Nyquist frequency. For instance, at least one of peaks 147-149 and/or at least one of peaks 157-159 produced in vibration signals 132-134 may be produced by a pronunciation of the vowel at a fundamental frequency corresponding to the associated vibration frequency, or they can be produced by a pronunciation of the vowel at a fundamental frequency larger than the associated vibration frequency, wherein an alias frequency of the fundamental frequency corresponds to the associated vibration frequency. For example, an own voice activity of a female voice characterized by higher vibration frequencies may thus be determined by a presence of the own voice characteristic at the alias vibration frequency of the fundamental frequency, whereas an own voice activity of a male voice characterized by lower vibration frequencies may be determined by a presence of the own voice characteristic at the fundamental frequency.

Depending on the outcome of the decision performed in operation 907, an occurrence of an own voice activity of the user is identified in operation 609 if the own voice characteristic in the vibration signal has been determined to be present at the fundamental vibration frequency associated with the own voice characteristic. Depending on the outcome of the decision performed in operation 908, an occurrence of an own voice activity of the user is identified in operation 609, if the own voice characteristic in the vibration signal has been determined to be present at the alias frequency of the fundamental vibration frequency. Conversely, a non-occurring own voice activity of the user is identified in operation 608 if the own voice characteristic in the vibration signal neither has been determined to be present at the fundamental vibration frequency after the decision in operation 907, nor at the alias vibration frequency after the decision in operation 908. The decisions according to operations 907, 908 may be performed simultaneously or in any order.

In some implementations, the decision performed in operation 907 can be omitted. Those implementations may correspond to some embodiments of the method illustrated in FIG. 6, wherein the decision according to operation 607 is replaced by the decision according to operation 908. Thus, the vibration frequency associated with the own voice characteristic can be selected as an alias frequency of the fundamental frequency of the vibration caused by the own voice activity. In some implementations, the decision performed in operation 908 can be omitted. Those implementations may correspond to some embodiments of the method illustrated in FIG. 6, wherein the decision according to operation 607 is replaced by the decision according to operation 907. Thus, the vibration frequency associated with the own voice characteristic can be selected as the fundamental frequency of the vibration caused by the own voice activity. In some implementations, another harmonic frequency than the fundamental frequency of the vibration caused by the own voice activity is selected as the vibration frequency associated with the own voice characteristic. The harmonic frequency can correspond to an integer multiple of the fundamental frequency. In some implementations, the harmonic frequency can be selected as the associated vibration frequency in the decision performed in operation 907. In some implementations, an alias frequency of the harmonic frequency can be selected as the associated vibration frequency in the decision performed in operation 908.

In some implementations, the maintaining of data relative to the own voice characteristic in operation 702, and/or the retrieving of the associated vibration frequency from the data in operation 703, as illustrated in FIG. 7, can be correspondingly applied. The data can comprise the fundamental vibration frequency associated with the respective own voice characteristic and/or the alias frequency of the fundamental vibration frequency. In some implementations, the comparing operation 704, as illustrated in FIG. 7, can be correspondingly applied and may be employed in at least one of the decisions in operations 907, 908. In some implementations, the classifying operation 804 based on the pattern of own voice characteristics provided in operation 805, as illustrated in FIG. 8, can be correspondingly applied, in particular with respect to a classification of the signal feature determined in operation 603 as an own voice feature and the associated vibration frequency as the fundamental vibration frequency and/or the fundamental alias frequency, and may be employed in at least one of the decisions in operations 907, 908.

Figure 10:
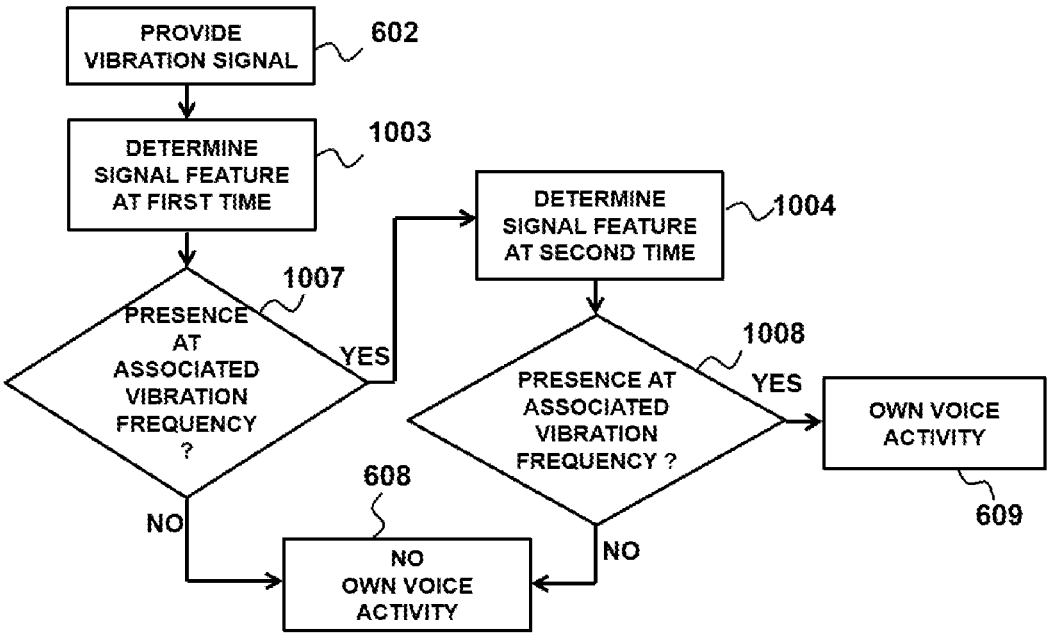

FIG. 10 illustrates another method of operating a hearing device for detection of an own voice activity of the user according to some embodiments of the present disclosure. The determining of a signal feature in the vibration signal in operation 1003 substantially corresponds to operation 603 described above, wherein the signal feature is determined at a first time in the vibration signal. The determining of a signal feature in the vibration signal in operation 1004 substantially corresponds to operation 603 described above, wherein the signal feature is determined at a second time in the vibration signal. The second time is different from the first time. The determined own voice characteristic at the second time can be different from the determined own voice characteristic at the first time, or it can be equal. The vibration frequency associated with the own voice characteristic at the second time can be different from the vibration frequency associated with the own voice characteristic at the first time, or it can be equal. To illustrate, a presence of at least one of peaks 147-149 in the first temporal section of vibration signals 132-134 may be determined in operation

1003, and a presence of at least one of peaks 157-159 in the second temporal section of vibration signals 132-134 may be determined in operation 1004. Operations 1003, 1004 can be performed in any order or they can be performed simultaneously. For instance, operation 603 in the method illustrated in FIG. 6 can comprise determining the signal feature at the vibration frequency associated with the own voice characteristic at the first time and determining the signal feature at the vibration frequency associated with the own voice characteristic at the second time. For instance, the vibration signal can be evaluated in a modulation analysis to determine a temporal behaviour of the presence of the own voice characteristic in the vibration signal, in particular temporal variations of the presence of the own voice characteristic. In some implementations, a presence of an own voice characteristic in the vibration signal is determined at least at one additional time in the vibration signal different from the first time and the second time. Taking into account the temporal behaviour of the vibration signal during own detection can improve the detection reliability.

The decision in operation 1007 depending on an identification criterion whether the own voice characteristic is determined to be present at the associated vibration frequency substantially corresponds to operation 607 described above, wherein the identification criterion further depends on whether the own voice characteristic is determined to be present at the first time in the vibration signal. The decision in operation 1008 depending on an identification criterion whether the own voice characteristic is determined to be present at the associated vibration frequency substantially corresponds to operation 607 described above, wherein the identification criterion further depends on whether the own voice characteristic is determined to be present at the second time in the vibration signal. Operations 1007, 1008 can be performed in any order or they can be performed simultaneously. In particular, operation 607 in the method illustrated in FIG. 6 can comprise both decisions depending on the own voice characteristic presence at the associated vibration frequency at the first time and the second time. Only if the own voice characteristic is determined to be present at the first time and the second time, an own voice activity of the user is identified in operation 609. Otherwise, if the own voice characteristic is not determined to be present at the first time and/or the second time, an non-occurrence of the own voice activity of the user is identified in operation 608.

In some implementations, the maintaining of data relative to the own voice characteristic in operation 702, and/or the retrieving of the associated vibration frequency from the data in operation 703, as illustrated in FIG. 7, can be correspondingly applied. The data can comprise the vibration frequency associated with the own voice characteristic at the first time and at the second time. In some implementations, the comparing operation 704, as illustrated in FIG. 7, can be correspondingly applied and may be employed in at least one of the decisions in operations 1007, 1008. In some implementations, the classifying operation 804 based on the pattern of own voice characteristics provided in operation 805, as illustrated in FIG. 8, can be correspondingly applied, in particular with respect to a classification of the signal feature determined in at least one of operations 1003, 1004 as an own voice feature at the first time and/or the second time, and may be employed in at least one of the decisions in operations 1007, 1008. In some implementations, the decision in operation 907 and/or the decision in operation 908, as illustrated in FIG. 9, can be correspondingly applied in the place of at least one of operations 1007, 1008, wherein the vibration frequency associated with the own voice characteristic at the first time and/or the second time is selected as the fundamental vibration frequency and/or an alias frequency of the fundamental vibration frequency.

Figure 11:
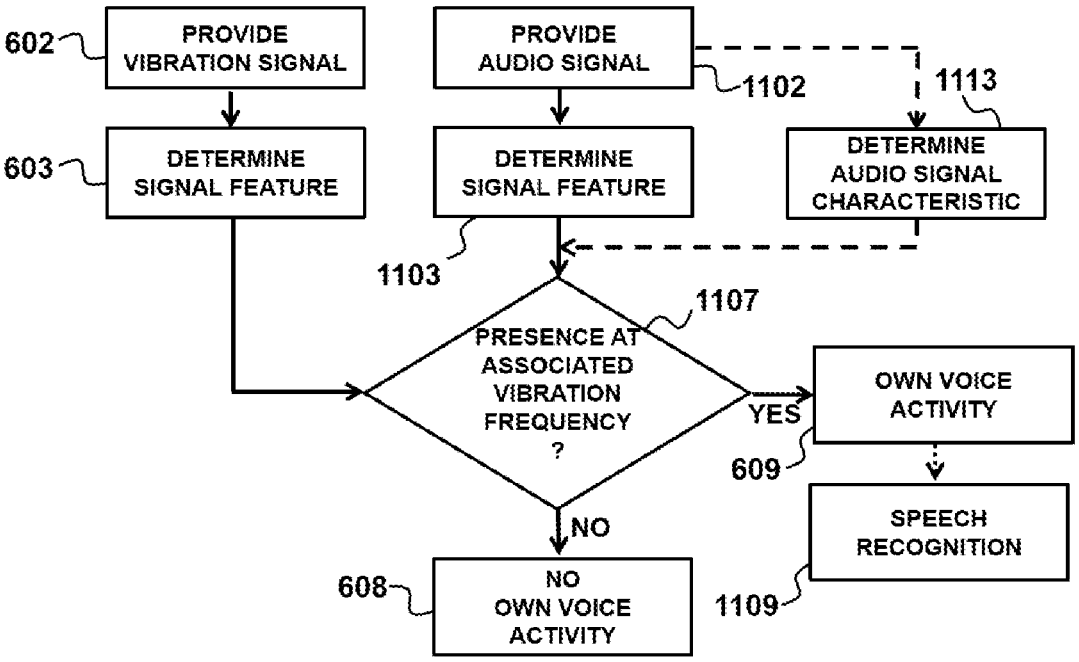

FIG. 11 illustrates another method of operating a hearing device for detection of an own voice activity of the user according to some embodiments of the present disclosure. In operation 1102, an audio signal indicative of an airborne sound is provided. The sound can comprise audio content generated in an environment of the user and/or audio content generated by an own voice activity of the user. The audio signal can be provided by microphone 106. In operation 1103, a signal feature in the audio signal is determined. The signal feature can be produced in the audio signal by the own voice activity. The signal feature can be a frequency dependent property of the audio signal such that it is characteristic for a specific audio frequency. The signal feature can comprise a peak at the audio frequency. To illustrate, the signal feature produced in the audio signal may be a peak at an audio frequency corresponding to or having a similar value as the vibration frequency at which at least one of peaks 147-149 and/or at least one of peaks 157-159 is produced in vibration signals 132-134. Alternatively or additionally, the signal feature can comprise another property, for instance a signal level larger than a specified minimum level at the audio frequency. Taking into account the audio signal during own detection can improve the detection reliability. Determining the signal feature can comprise employing a peak detection in the audio signal. In some implementations, the audio signal can be evaluated in a frequency domain comprising a spectrum of audio frequencies. This may imply converting a time dependent audio signal from a time domain into the frequency domain. In some implementations, the signal feature can be determined directly in a time dependent audio signal.

In operation 1107, a decision is performed depending on an identification criterion. The identification criterion can be based on at least one of whether the own voice characteristic is determined to be present in the vibration signal at a vibration frequency associated with the own voice characteristic, and whether the own voice characteristic is determined to be present in the audio signal at an audio frequency associated with the own voice characteristic. In some implementations, determining the presence of the own voice characteristic at the associated frequency can comprise determining the signal feature in the vibration signal and/or audio signal and simultaneously determining a presence of the signal feature at the frequency associated with the own voice characteristic in at least one of operations 603, 1103. In some implementations, determining the presence of the own voice characteristic at the associated frequency can also comprise subsequent determining of a signal feature in the vibration signal and/or audio signal in at least one of operations 603, 1103 and then determining the presence of the signal feature at the frequency associated with the own voice characteristic.

In some implementations, the identification criterion can be based on a similarity measure between the signal feature determined in the vibration signal in operation 603 and the signal feature determined in the audio signal in operation 1103. Determining the similarity measure can comprise determining a comparison and/or a correlation, for instance a cross-correlation, of the vibration signal and the audio signal with respect to the frequency at which the signal feature determined in operations 603, 1103 has been determined to be present. Thus, the vibration frequency and the audio frequency at which the signal feature has been determined to be present in operations 603, 1103 can be evaluated with respect to the comparison and/or correlation. The decision in operation 1107 can be performed depending on whether the similarity measure has been determined to be large enough. In particular, the identification criterion may be provided such that the vibration frequency at which the signal feature has been determined to be present in operation 603 and the audio frequency at which the signal feature has been determined to be present in operation 1103 must be similar to a specified degree, for instance such that they are shifted by a certain frequency difference or by at most a maximum value of a frequency difference or such that they are substantially equal. When the similarity measure has been determined to be large enough, at least one of the signal feature determined in operation 603 can be identified as the own voice characteristic determined to be present in the vibration signal at the associated vibration frequency and the signal feature determined in operation 1103 can be identified as the own voice characteristic determined to be present in the audio signal at the associated audio frequency.

In some implementations, at least one of the vibration frequency associated with the own voice characteristic in the vibration signal and the audio frequency associated with the own voice characteristic in the audio signal is set to a predetermined frequency. For instance, at least one of the associated vibration frequency and the associated audio frequency can be retrieved from a database by applying an operation corresponding to operation 703 illustrated in FIG. 7. The decision in operation 1107 can then be performed depending on at least one of whether the own voice characteristic is determined to be present in the vibration signal at the associated vibration frequency, and whether the own voice characteristic is determined to be present in the audio signal at the associated audio frequency, in particular depending on whether both criteria are fulfilled.

In some implementations, the maintaining of data relative to the own voice characteristic in operation 702, and/or the retrieving of the associated vibration frequency from the data in operation 703, as illustrated in FIG. 7, can be correspondingly applied. The data can comprise the vibration frequency associated with the own voice characteristic in the vibration signal and/or the vibration frequency associated with the own voice characteristic in the vibration signal. In some implementations, the comparing operation 704, as illustrated in FIG. 7, can be correspondingly applied and may be employed in the decisions in operation 1107. In some implementations, the classifying operation 804 based on the pattern of own voice characteristics provided in operation 805, as illustrated in FIG. 8, can be correspondingly applied, in particular with respect to a classification of the signal feature determined in the vibration signal in operation 602 and/or with respect to a classification of the signal feature determined in the audio signal in operation 1102. In some implementations, the decision in operation 907 and/or the decision in operation 908, as illustrated in FIG. 9, can be correspondingly applied in the place operations 1107, wherein the vibration frequency and/or the audio frequency associated with the own voice characteristic is selected as the fundamental vibration frequency and/or an alias frequency of the fundamental vibration frequency. In some implementations, the determining of the signal feature at multiple times in operations 1004, 1005 can be correspondingly applied in place of operation 603 and/or in place of operation 1103. Decision operations 1007, 1008 for the own voice characteristic at multiple times may be correspondingly performed at operation 1107.

In some implementations, an audio signal characteristic is determined from the audio signal in operation 1113. Determining the audio signal characteristic can comprise estimating a signal to noise ratio (SNR) of the audio signal. Determining the audio signal characteristic can comprise estimating a volume level of the audio signal, in particular a volume level of the own voice activity and/or a volume level of other sound in the environment. The determined audio signal characteristic can be employed during the decision performed in operation 1107. For instance, a significance of the signal feature determined to be present in the audio signal can depend on an estimated SNR of the audio signal. For instance, the identification criterion applied in the decision in operation 1107 may predominantly depend on whether the signal feature is determined to be present in the vibration signal at the vibration frequency associated with the own voice characteristic when the SNR is estimated to be rather high in the audio signal. In some implementations, at least one of the vibration frequency associated with the own voice characteristic in the vibration signal and the audio frequency associated with the own voice characteristic in the audio signal is set depending on the audio signal characteristic. In particular, the audio signal characteristic can comprise an estimated volume level of the audio signal and at least one of the vibration frequency associated with the own voice characteristic in the vibration signal and the audio frequency associated with the own voice characteristic in the audio signal can be set depending on the estimated volume level, in order to account for the "Lombard effect" causing a frequency shift of the detected own voice activity at different speech volumes of the user.

In some implementations, a speech recognition is performed in operation 1109. The speech recognition can be used to identify a content of a speech of the user during the own voice activity, for instance keywords spoken by the user. The speech recognition can employ the own voice characteristic determined in the vibration signal at the associated vibration signal and/or the own voice characteristic determined in the audio signal at the associated audio signal. To illustrate, peaks 147-149 and/or peaks 157-159 produced in vibration signals 132-134 may be identified as the respective vowels spoken by the user. In order to identify a plurality of vowels, consonants, words, phonemes, speech pauses, etc. successively spoken by the user, the own voice characteristic can be determined in the vibration signal and/or in the audio signal at different times, in particular by correspondingly applying operations 1003, 1004 illustrated in FIG. 10 in the place of operation 603 and/or in the place of operation 1103. For instance, the vibration signal and/or the audio signal may be evaluated in a modulation analysis to determine the own voice characteristic at the associated frequency at different times. In some implementations, the determination of the own voice characteristic at different times can be employed in addition to another speech recognition process, in order to improve and/or stabilize the performance of the speech recognition.

Figure 12:
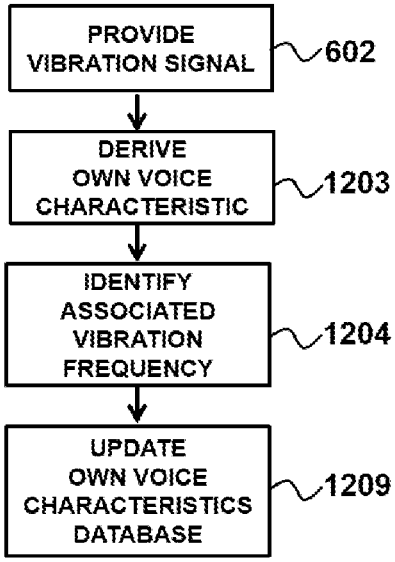

FIG. 12 illustrates a method of providing data relative to an own voice characteristic and a vibration frequency associated with the own voice characteristic. The data can be representative of parameters that are employed for an own voice detection according to the methods described above in conjunction with FIGS. 6-11. The data can be stored in memory 104 and/or processed by processor 102. The data may be employed, for instance, in operation 702 of maintaining data relative to own voice characteristics in a database, and/or in operation 703 of retrieving a vibration frequency associated with the own voice characteristic from the data, as illustrated in FIG. 7. After providing the vibration signal in operation 602, an own voice characteristic is derived in the vibration signal in operation 1203. A vibration frequency associated with the own voice characteristic is identified in operation 1204. Operations 1203, 1204 can be performed simultaneously or subsequently. The identified vibration frequency associated with the own voice feature is stored in a database for own voice characteristics in operation 1209. The associated vibration frequency can be retrieved from the database, in particular in the methods illustrated in FIGS. 6-11, to determine the presence of the own voice characteristic at the associated vibration frequency.

In some implementations, operation 1203 of deriving the own voice characteristic can comprise determining a signal feature in operation 603 and classifying the signal feature as the own voice characteristic. In particular, classifying operation 804 based on a pattern of own voice characteristics provided in operation 805, as illustrated in FIG. 8, can be correspondingly applied. In this way, the vibration frequency associated with the own voice characteristic can be identified in operation 1204, in particular as the vibration frequency at which the own voice characteristic has been determined to be present in operation 1203. The associated vibration frequency may thus be identified despite variations of the frequency occurring at different conditions, for instance different users, different volume levels of the own voice activity, different environmental settings, etc.

In some implementations, operation 1203 of deriving the own voice characteristic can comprise initiating a training operation for an individual user. During the training operation, the user can be instructed to perform a predetermined own voice activity. The own voice characteristic in the vibrations signal that can be attributed to the own voice activity can thus be identified during operation 1203. The associated vibration frequency can thus be identified during operation 1204, in particular as the vibration frequency at which the own voice characteristic has been determined to be present in operation 1203. Initiating the training operation can comprise, for instance, instructing the user to pronounce a certain number of vowels, consonants, phonemes, words, etc. The user may also be instructed to perform the own voice activity at different volume levels.

Figure 13:
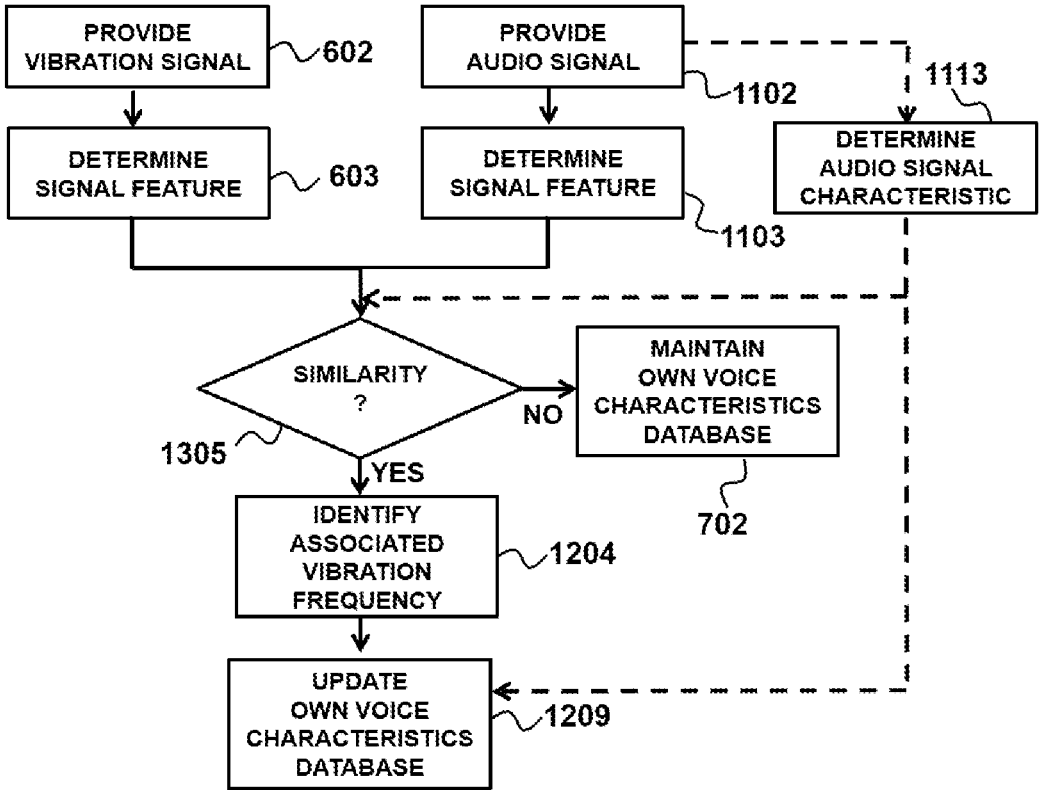

FIG. 13 illustrates another method of providing data relative to an own voice characteristic and a vibration frequency associated with the own voice characteristic. In operation 1305, a similarity relation between the signal feature determined in the vibration signal in operation 603 and the signal feature determined in the vibration signal in operation 1103 is determined. Similarity determining operation 1305 can comprise determining a similarity measure between the signal feature determined in the vibration signal and the audio signal. Determining the similarity measure can comprise determining a comparison and/or correlation, for instance a cross-correlation, of the vibration signal and the audio signal with respect to the frequency at which the signal features have been determined. Thus, the signal features determined in operations 603, 1103 can be evaluated with respect to the comparison and/or correlation. In particular, the vibration frequency and the audio frequency at which the signal features have been determined in operations 603, 1103 can be evaluated with respect to the comparison and/or correlation.

A decision in operation 1305 can then be performed depending on the determined similarity measure. In a situation in which a determined similarity has been determined to be larger than a similarity threshold, for instance a correlation has been determined to be large enough, at least one of a vibration frequency associated with the own voice characteristic in the vibration signal and an audio frequency associated with the own voice characteristic in the audio signal can be identified based on the similarity measure in operation 1204. For instance, the associated vibration frequency and/or the associated audio frequency may then be selected to correspond to the vibration frequency and/or audio frequency at which the at least one of the signal features has been determined in operations 603, 1103. The associated vibration frequency and/or the associated audio frequency can then be stored in the data base for own voice characteristics in operation 1209. In a contrary situation, in which the similarity has not been determined to be larger than the similarity threshold, the associated vibration frequency and/or the associated audio frequency cannot be identified and the data base for own voice characteristics is maintained in its present state in operation 702.

In some implementations, operation 1113 of determining an audio signal characteristic, as described above in conjunction with the method illustrated FIG. 11, can be employed during the decision performed in operation 1305. In particular, determining the similarity measure and/or setting a similarity threshold can depend on the audio signal characteristic. For instance, the similarity threshold can be set depending on an estimated SNR of the audio signal. For instance, the similarity measure can be determined depending on an estimated volume level of the audio signal, in particular to account for a frequency shift of the detected own voice activity at different speech volumes of the user caused by the "Lombard effect". In some implementations, an audio signal characteristic determined in operation 1113 can be stored in the data base for own voice characteristics in operation 1209. The audio signal characteristic related to the own voice characteristic can thus be retrieved from the database in addition to the associated vibration frequency and/or audio frequency identified in operation 1204.

In some implementations, the hearing device is configured to operate in a first mode of operation in which an own voice activity of the user is detected and in a second mode of operation in which the hearing device can be prepared for the detection of the own voice activity. The first mode of operation may be implemented by at least one of the methods illustrated in FIGS. 6-11 and/or other combinations of the operations illustrated in those methods. The second mode of operation may be implemented by at least one of the methods illustrated in FIGS. 12 and 13 and/or other combinations of the operations illustrated in those methods.

FIGS. 14-18 illustrate exemplary signal processing configurations of a hearing device according to some embodiments of the present disclosure. Other embodiments may omit, add to, reorder and/or modify any of the functional components shown in FIGS. 14-18. Some embodiments may be implemented in hearing device 100 illustrated in FIG. 1. In particular, some of the illustrated functional components may be operated by processor 102, for instance in a signal processing routine, algorithm, program and/or the like. Other illustrated functional components may be operatively coupled to processor 102, for instance to provide and/or modify a signal processed by processor 102. Some embodiments may be implemented in a hearing device comprising additional constituent parts, for instance an additional microphone and/or beamformer. Some embodiments may be implemented in a hearing system comprising two hearing devices in a binaural configuration.

Figure 14:
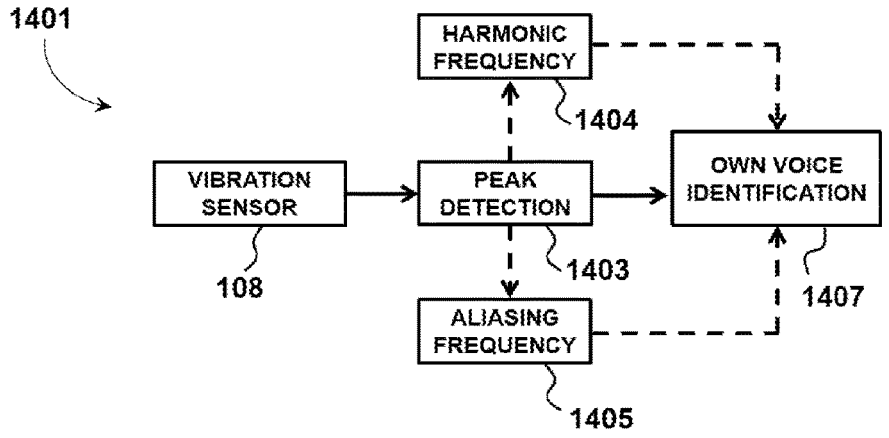
FIGS. 14-18 illustrate exemplary signal processing configurations that may be implemented by the hearing device illustrated in FIG. 1, in accordance with some embodiments of the present disclosure.

FIG. 14 illustrates an exemplary signal processing configuration 1401 for a signal processing of a vibration signal provided by vibration sensor 108. As shown, signal processing configuration 1401 comprises a peak detector 1403 configured for peak detection in the vibration signal. To illustrate, peak detector 1403 can be configured to detect at least one of peaks 147-149 and/or at least one of peaks 157-159 produced in vibration signals 132-134 at an associated vibration frequency. For instance, peak detector 1403 can be configured to perform at least one of operations 603, 1003, 1004. Signal processing configuration 1401 further comprises an own voice identifier 1407 configured to identify an own voice activity based on an identification criterion. The identification criterion can comprise the presence of the detected peak or at least one of the detected peaks at a vibration frequency associated with an own voice characteristic. For instance, own voice identifier 1407 can be configured to perform at least one of operations 607, 907, 908, 1007, 1008. Peak detector 1403 and/or own voice identifier 1407 may be operated by processor 102.

In some implementations, peak detector 1403 is configured for peak detection at an harmonic frequency, for instance the fundamental frequency, of the vibration detected by vibration sensor 108, as illustrated by component 104 constituting a harmonic frequency peak detector. A determination, if the detected peak is present at the harmonic frequency, can be carried out simultaneously during peak detection, for instance by harmonic frequency peak detector 1404, or after peak detection, for instance by own voice identifier 1407. In some implementations, peak detector 1403 is configured for peak detection at an alias frequency, of the vibration detected by vibration sensor 108, as illustrated by component 105 constituting an alias frequency peak detector. A determination, if the detected peak is present at the alias frequency, can be carried out simultaneously during peak detection, for instance by alias frequency peak detector 1405, or after peak detection, for instance by own voice identifier 1407.

Figure 15:
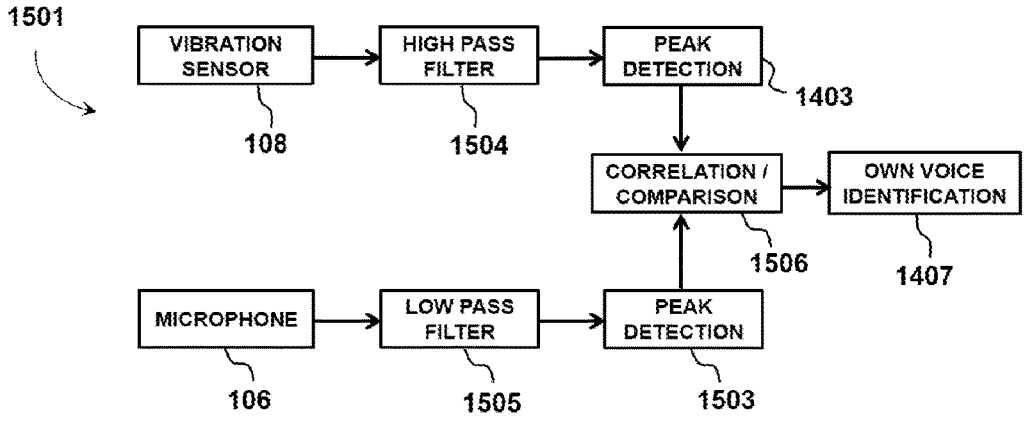

FIG. 15 illustrates an exemplary signal processing configuration 1501 for a signal processing of a vibration signal provided by vibration sensor 108, and an audio signal provided by microphone 106. A high pass filter 1504 is provided to modify the vibration signal before the peak detection by peak detector 1403. High pass filter 1504 can thus provide the vibration signal with a signal content that is of specific interest for the detection of an own voice activity, in particular such that the peak detection can be facilitated. A low pass filter 1505 is provided to modify the audio signal before a peak detection in the audio signal by a peak detector 1503. For instance, peak detector 1503 can be configured to perform operation 1103. Low pass filter 1505 can thus provide the audio signal with a signal content that is of specific interest for the detection of an own voice activity, in particular such that the peak detection by audio signal peak detector 1503 can be facilitated. Vibration signal peak detector 1403 can comprise harmonic frequency peak detector 1404 and/or alias frequency peak detector 1405, as illustrated in FIG. 14. Audio signal peak detector 1503 can comprise corresponding components configured for peak detection at an harmonic frequency of the sound detected by microphone 106 and/or at an alias frequency of the sound. Signal processing configuration 1501 further comprises a correlator and/or comparator 1506. Correlator and/or comparator 1506 is configured to correlate and/or compare the peaks detected by vibration signal peak detector 1403 and audio signal peak detector 1503. For instance, correlator and/or comparator 1506 can be configured to perform operation 1305. A result of the correlation and/or comparison is provided to own voice identifier 1407. The identification criterion applied by own voice identifier 1407 can comprise the result of the correlation and/or comparison.

Figure 16:
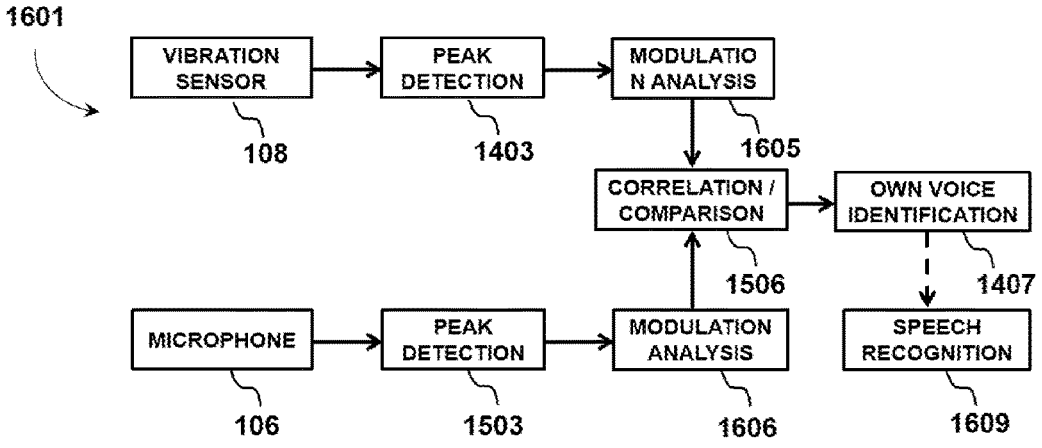

FIG. 16 illustrates another exemplary signal processing configuration 1601 for a signal processing of a vibration signal provided by vibration sensor 108, and an audio signal provided by microphone 106. Signal processing configuration 1601 comprises a modulation analyzer 1605 configured to evaluate the vibration signal in a modulation analysis. The vibration signal modulation analyzer 1605 can thus provide temporal information about the peaks detected by peak detector 1403. For instance, modulation analyzer 1605 can provide information if a first peak detected by peak detector 1403 temporally precedes a second peak detected by peak detector 1403 in the vibration signal. For instance, modulation analyzer 1605 can provide information about a time interval between the detected peaks. Signal processing configuration 1601 comprises another modulation analyzer 1606 configured to evaluate the audio signal in a corresponding way with respect to the peaks detected by audio signal peak detector 1503 for different times in the audio signal. The temporal information provided by the audio signal modulation analyzer 1606 and vibration signal modulation analyzer 1605 can be used by correlator and/or comparator 1506, in particular to correlate and/or compare the peaks detected by vibration signal peak detector 1403 and audio signal peak detector 1503 at corresponding times. The temporal information provided by the audio signal modulation analyzer 1606 and vibration signal modulation analyzer 1605 can further be used by own voice identifier 1407 to identify the own voice activity based on the temporal information. For instance, the identification criterion applied by own voice identifier 1407 can comprise that a time interval between the detected peaks determined by vibration signal modulation analyzer 1605 and/or audio signal modulation analyzer 1606 corresponds to a predetermined time interval and/or does not exceed a predetermined maximum duration.

In some implementations, signal processing configuration 1601 further comprises a speech recognizer 1609. Speech recognizer 1609 is configured to identify a content of a speech of the user identified as an own voice activity by own voice identifier 1407. The speech recognition can be based on spectral information comprising the frequencies associated with the previously detected peaks by peak detectors 1403, 1503 and/or temporal information comprising the time interval between the detected peaks provided by modulation analyzers 1605, 1606. For instance, keywords and/or commands and/or sentences spoken by the user may be identified in such a configuration.

Figure 17:
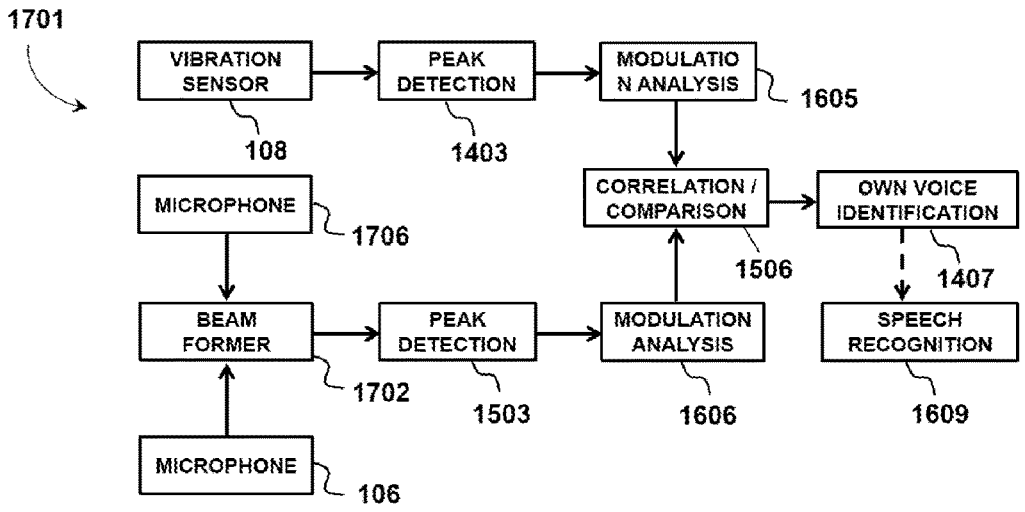

FIG. 17 illustrates another exemplary signal processing configuration 1701 for a signal processing of a vibration signal provided by vibration sensor 108, and an audio signal provided by microphone 106. In addition to microphone 106, at least one further microphone 1706 is provided configured to detect the sound detected by microphone 106 at a distance to microphone 106, and to provide a supplementary audio signal comprising information about this sound. For instance, microphone 1706 can be implemented in hearing device 100. The audio signal provided by microphone 106 and the supplementary audio signal provided by supplementary microphone 1706 are processed by a beamformer 1702. A directionality of the beamformer is directed toward the user's mouth when an own voice activity has been identified by own voice identifier 1407, in particular to improve further detection of the own voice activity and/or the speech recognition by speech recognizer 1609.

In some implementations, an audio signal comprising information about the multiple audio signals provided by microphones 106, 1706 is provided by beamformer 1702 to audio signal peak detector 1503 and to audio signal modulation analyzer 1606. In some implementations, the audio signal provided by microphone 106 and the audio signal provided by microphone 1706 are provided separately to audio signal peak detector 1503 and to audio signal modulation analyzer 1606. Correlator and/or comparator 1506 can be configured to correlate and/or compare the peaks detected by vibration signal peak detector 1403 in the vibration signal and the peaks detected by audio signal peak detector 1503 in the respective audio signal of both microphones 106, 1706.

Figure 18:
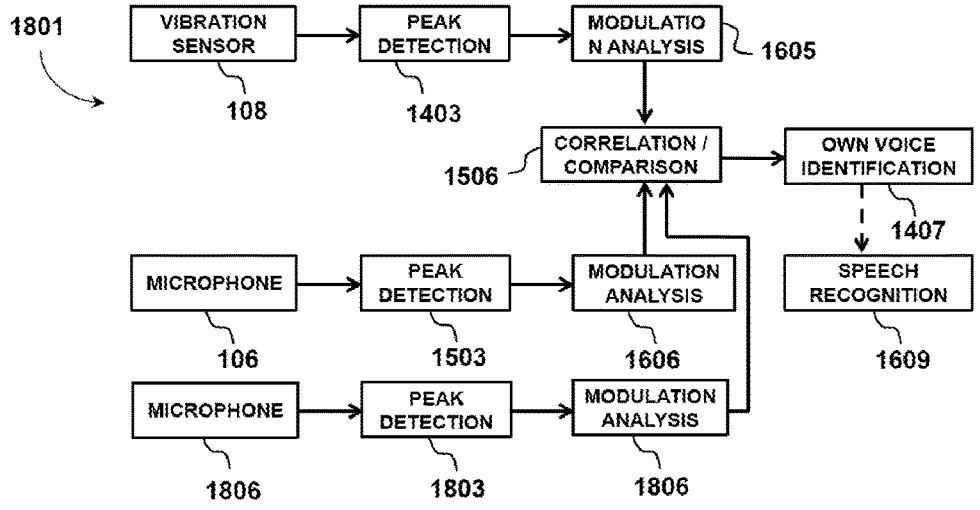

FIG. 18 illustrates another exemplary signal processing configuration 1801 for a signal processing of a vibration signal provided by vibration sensor 108, and an audio signal provided by microphone 106. An additional microphone 1806 is provided. Additional microphone 1806 can be implemented in an additional hearing device corresponding to hearing device 100, in the place of microphone 106. A hearing system comprising hearing device 100 and the additional hearing device can thus be worn in a binaural configuration. Additional microphone 1806 is configured to detect sound from the environment during sound detection of microphone 106 and to provide an additional audio signal. The additional audio signal provided by microphone 8106 is provided to an additional audio signal peak detector 1803 and an additional audio signal modulation analyzer 1806. Correlator and/or comparator 1506 can be configured to correlate and/or compare the peaks detected by vibration signal peak detector 1403 in the vibration signal, the peaks detected by audio signal peak detector 1503 in the audio signal of microphone 106, and the peaks detected by additional audio signal peak detector 1803 in the additional audio signal of additional microphone 1806. In some implementations, each of microphones 106 and 1806 may be operatively connected to a beamformer to enable binaural beamforming. In particular, the configuration depicted in FIG. 17 comprising beamformer 1702 may be correspondingly applied, wherein microphone 1706 may be provided in hearing device 100 and another corresponding microphone may be provided in the additional hearing device at a distance to microphone 1806.

While the principles of the disclosure have been described above in connection with specific devices and methods, it is to be clearly understood that this description is made only by way of example and not as limitation on the scope of the invention. The above described preferred embodiments are intended to illustrate the principles of the invention, but not to limit the scope of the invention. Various other embodiments and modifications to those preferred embodiments may be made by those skilled in the art without departing from the scope of the present invention that is solely defined by the claims.

What is claimed is:

1. A hearing device configured to be worn at least partially at a head of a user, the hearing device comprising:

a vibration sensor configured to detect a vibration conducted through the user's head to the hearing device, at least a part of the vibration caused by an own voice activity of the user, and to output a vibration signal comprising information about said vibration; and a processor communicatively coupled to the vibration sensor;

wherein the processor is configured to:

determine a presence of a first own voice characteristic in the vibration signal at a first vibration frequency associated with the first own voice characteristic, said first associated vibration frequency being selected such that it comprises a harmonic frequency of said part of the vibration caused by the own voice activity and the first own voice characteristic being indicative of said part of the vibration caused by the own voice activity;

determine a presence of a second own voice characteristic in the vibration signal at an associated second vibration frequency; and identify the own voice activity based on an identification criterion comprising said presence of the first own voice characteristic in the vibration signal at the associated first vibration frequency, and said presence of the second own voice characteristic in the vibration signal at the associated second vibration frequency.

2. The device according to claim 1, characterized in that the processor is configured to determine a temporal sequence of said presence of the first own voice characteristic and the second own voice characteristic in the vibration signal, wherein said identification criterion further comprises said presence of the first own voice characteristic temporally preceding said presence of the second own voice characteristic in the vibration signal.

3. The device according to claim 1, characterized in that at least one of the first own voice characteristic or the second own voice characteristic comprises a peak of the vibration signal at at least one of the first associated vibration frequency or the second associated vibration frequency.

4. The device according to claim 1, characterized a microphone configured to detect a sound conducted through an ambient environment of the user and to output an audio signal comprising information about said sound, the processor communicatively coupled to the microphone.

5. The device according to claim 4, characterized in that the processor is configured to determine a presence of an own voice characteristic in the audio signal at an audio frequency associated with the own voice characteristic, the own voice characteristic in the audio signal indicative of at least a part of said sound which is caused by the own voice activity, wherein said identification criterion further comprises said presence of the own voice characteristic in the audio signal at the associated audio frequency.

6. The device according to claim 5, characterized in that the processor is configured to:

determine a signal feature of the vibration signal;

determine a signal feature of the audio signal; and determine a similarity measure between the signal feature of the vibration signal and the signal feature of the audio signal, wherein at least one of said presence of at least one of the first own voice characteristic or the second own voice characteristic in the vibration signal at least one of the first associated vibration frequency or the second associated vibration frequency and said presence of the own voice characteristic in the audio signal at the associated audio frequency is determined based on the similarity measure.

7. The device according to claim 4, characterized in that the processor is configured to determine an intensity of the audio signal and to select said associated vibration frequency depending on said audio signal intensity.

8. The device according to claim 1, characterized in that the vibration sensor comprises an accelerometer.

9. The device according to claim 1, characterized in that said vibration signal comprises first directional data indicative of a first direction of said part of the vibration caused by the own voice activity, and second directional data indicative of a second direction of said part of the vibration caused by the own voice activity, wherein the processor is configured to determine said presence of at least one of the first own voice characteristic or the second own voice characteristic in the first directional data and in the second directional data, wherein said identification criterion further comprises a coincidence of said presence of at least one of the first own voice characteristic or the second own voice characteristic in the first directional data and in the second directional data.

10. The device according to claim 1, characterized in that at least one of the first associated vibration frequency or the second associated vibration frequency is selected such that it comprises an alias frequency of a frequency of said part of the vibration caused by the own voice activity.

11. The device according to claim 1, characterized in that the processor is configured to evaluate the vibration signal at a sampling rate of at most 1 kHz.

12. The device according to claim 1, characterized in that the processor is configured to determine a signal feature of the vibration signal; classify, based on a pattern of own voice characteristics, the signal feature as at least one of the first own voice characteristic or the second own voice characteristic; and identify the vibration frequency associated with at least one of the first own voice characteristic or the second own voice characteristic.

13. A method of operating a hearing device configured to be worn at least partially at a head of a user, the method comprising:

detecting a vibration conducted through the user's head to the hearing device, at least a part of the vibration caused by an own voice activity of the user;

providing a vibration signal comprising information about said vibration;

determining a presence of a first own voice characteristic in the vibration signal at a first vibration frequency associated with the first own voice characteristic, said associated first vibration frequency being selected such that it comprises a harmonic frequency of said part of the vibration caused by the own voice activity and the first own voice characteristic being indicative of said part of the vibration caused by the own voice activity;

determining a presence of a second own voice characteristic in the vibration signal at an associated second vibration frequency; and identifying the own voice activity based on an identification criterion comprising said determined presence of the first own voice characteristic in the vibration signal at the associated vibration frequency and said presence of the second own voice characteristic in the vibration signal at the associated second vibration frequency.

14. A hearing device configured to be worn at least partially at a head of a user, the hearing device comprising:

a vibration sensor configured to detect a vibration conducted through the user's head to the hearing device, at least a part of the vibration caused by an own voice activity of the user, and to output a vibration signal comprising information about said vibration;

a processor communicatively coupled to the vibration sensor;

a microphone configured to detect a sound conducted through an ambient environment of the user and to output an audio signal comprising information about said sound, the processor communicatively coupled to the microphone;

wherein the processor is configured to:

determine a presence of an own voice characteristic in the vibration signal at a vibration frequency associated with the own voice characteristic, said associated vibration frequency being selected such that it comprises a harmonic frequency of said part of the vibration caused by the own voice activity and the own voice characteristic being indicative of said part of the vibration caused by the own voice activity;

determine a presence of the own voice characteristic in the audio signal at an audio frequency associated with the own voice characteristic, the own voice characteristic in the audio signal indicative of at least a part of said sound which is caused by the own voice activity;

determine a signal feature of the vibration signal;

determine a signal feature of the audio signal;

determine a similarity measure between the signal feature of the vibration signal and the signal feature of the audio signal, wherein at least one of said presence of the own voice characteristic in the vibration signal at the associated vibration frequency and said presence of the own voice characteristic in the audio signal at the associated audio frequency is determined based on the similarity measure; and to identify the own voice activity based on an identification criterion comprising said presence of the own voice characteristic in the vibration signal at the associated, and said presence of the own voice characteristic in the audio signal at the associated audio frequency.

15. A method of operating a hearing device configured to be worn at least partially at a head of a user, the method comprising:

detecting a vibration conducted through the user's head to the hearing device, at least a part of the vibration caused by an own voice activity of the user;

detecting a sound conducted through an ambient environment of the user;

providing a vibration signal comprising information about said vibration;

providing an audio signal comprising information about said sound;

determining a presence of an own voice characteristic in the vibration signal at a vibration frequency associated with the own voice characteristic, said associated vibration frequency being selected such that it comprises a harmonic frequency of said part of the vibration caused by the own voice activity and the own voice characteristic being indicative of said part of the vibration caused by the own voice activity;

determining a presence of an own voice characteristic in the audio signal at an audio frequency associated with the own voice characteristic, the own voice characteristic in the audio signal indicative of at least a part of said sound which is caused by the own voice activity;

determining a signal feature of the vibration signal;

determining a signal feature of the audio signal;

determining a similarity measure between the signal feature of the vibration signal and the signal feature of the audio signal;

determining at least one of said presence of the own voice characteristic in the vibration signal at the associated vibration frequency and said presence of the own voice characteristic in the audio signal at the associated audio frequency is based on the similarity measure; and identifying the own voice activity based on an identification criterion comprising said determined presence of the own voice characteristic in the vibration signal at the associated vibration frequency, and said determined presence of the own voice characteristic in the audio signal at the associated audio frequency.

16. A hearing device configured to be worn at least partially at a head of a user, the hearing device comprising:

a vibration sensor configured to detect a vibration conducted through the user's head to the hearing device, at least a part of the vibration caused by an own voice activity of the user, and to output a vibration signal comprising information about said vibration;

a processor communicatively coupled to the vibration sensor;

a microphone configured to detect a sound conducted through an ambient environment of the user and to output an audio signal comprising information about said sound, the processor communicatively coupled to the microphone;

wherein the processor is configured to:

determine an intensity of the audio signal;

determine a presence of an own voice characteristic in the vibration signal at a vibration frequency associated with the own voice characteristic, said associated vibration frequency being selected such that it comprises a harmonic frequency of said part of the vibration caused by the own voice activity, the own voice characteristic being indicative of said part of the vibration caused by the own voice activity, and said audio signal intensity;

and to identify the own voice activity based on an identification criterion comprising said presence of the own voice characteristic in the vibration signal at the associated.

17. A method of operating a hearing device configured to be worn at least partially at a head of a user, the method comprising:

detecting a vibration conducted through the user's head to the hearing device, at least a part of the vibration caused by an own voice activity of the user;

detecting a sound conducted through an ambient environment of the user;

providing a vibration signal comprising information about said vibration;

providing an audio signal comprising information about said sound;

determining an intensity of the audio signal;

determining a presence of an own voice characteristic in the vibration signal at a vibration frequency associated with the own voice characteristic, said associated vibration frequency being selected such that it comprises a harmonic frequency of said part of the vibration caused by the own voice activity, the own voice characteristic being indicative of said part of the vibration caused by the own voice activity, and said audio signal intensity; and identifying the own voice activity based on an identification criterion comprising said determined presence of the own voice characteristic in the vibration signal at the associated vibration frequency.

* * * * *